US011764502B2

(12) United States Patent
Hashiguchi

(10) Patent No.: US 11,764,502 B2
(45) Date of Patent: Sep. 19, 2023

(54) SOLDERABLE COMPONENT AND BOARD ASSEMBLY

(71) Applicant: Japan Aviation Electronics Industry, Limited, Tokyo (JP)

(72) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 114 days.

(21) Appl. No.: 17/315,574

(22) Filed: May 10, 2021

(65) Prior Publication Data

US 2022/0037816 A1 Feb. 3, 2022

(30) Foreign Application Priority Data

Jul. 28, 2020 (JP) ..... 2020-127388

(51) Int. Cl.
*H01R 12/57* (2011.01)
*H01R 4/02* (2006.01)

(52) U.S. Cl.
CPC ..... *H01R 12/57* (2013.01); *H01R 4/027* (2013.01); *Y10S 439/94* (2013.01)

(58) Field of Classification Search
CPC ..... H01R 12/57; H01R 4/027; H01R 43/205; Y10S 439/94
See application file for complete search history.

(56) References Cited

U.S. PATENT DOCUMENTS 7,581,965 B1 * 9/2009 Upasani ..... H05K 3/32 439/82
2020/0176902 A1 * 6/2020 Fu ..... H05K 1/181

FOREIGN PATENT DOCUMENTS

EP 0806063 B1 * 10/2002
JP H05-326104 A 12/1993
JP 2007-026876 A 2/2007
JP 2009-060335 A 3/2009

OTHER PUBLICATIONS

Machine Translation EP 0806063 B1, (Oct. 23, 2002) (Year: 2023).*

* cited by examiner

*Primary Examiner* — Travis S Chambers
(74) *Attorney, Agent, or Firm* — Collard & Roe, P.C.

(57) ABSTRACT

A solderable component comprises a body portion configured to be mounted on a board and an auxiliary portion extending from the body portion. The body portion has at least two solderable portions. The at least two solderable portions include two predetermined solderable portions. The auxiliary portion has one abutment portion and a coupling portion. The abutment portion and lower ends of the two predetermined solderable portions define a board-attachment plane which is an imaginary plane. The coupling portion couples the abutment portion and the body portion to each other. A boundary between the coupling portion and the body portion is apart from the abutment portion in a plane in parallel to the board-attachment plane. The coupling portion is separable from the body portion at the boundary between the coupling portion and the body portion.

10 Claims, 16 Drawing Sheets

SOLDERABLE COMPONENT AND BOARD ASSEMBLY

CROSS REFERENCE TO RELATED APPLICATIONS

This application is based on and claims priority under 35 U.S.C. § 119 to Japanese Patent Application No. JP 2020-127388 filed Jul. 28, 2020, the content of which is incorporated herein in its entirety by reference.

BACKGROUND OF THE INVENTION

This invention relates to a solderable component configured to be soldered on a board and relates to a board assembly formed by using the solderable component.

For example, a connector device, which is an example of this type of solderable component, is disclosed in JP 2007-26876A (Patent Document 1), the content of which is incorporated herein by reference.

As shown in FIG. 30, Patent Document 1 discloses a connector device 900 comprising a connector body 910 and a spacing member 920. The connector body 910 has a solderable portion 912. The spacing member 920 is removed after the connector body 910 is installed on a board. Since the connector device 900 is provided with the spacing member 920, the connector device 900 can stand by itself on a board even in an instance where the connector body 910 is not configured to stand by itself on the board.

According to the structure of the connector device of Patent Document 1, the connector device might easily fall down, for example, when the connector body has a tall height so that the center of gravity of the connector device is located upper than that of the connector device illustrated in FIG. 30. This problem might be caused not only on the connector device but also on a general solderable component which comprises a body portion such as the connector body and an auxiliary portion such as the spacing member.

SUMMARY OF THE INVENTION

It is an object of the present invention to provide a solderable component which can stably stand by itself on a board upon soldering even when a body portion has a tall structure.

An aspect of the present invention provides a solderable component comprising a body portion configured to be mounted on a board and an auxiliary portion extending from the body portion. The body portion has at least two solderable portions. The at least two solderable portions include two predetermined solderable portions. The auxiliary portion has one abutment portion and a coupling portion. The abutment portion and lower ends of the two predetermined solderable portions define a board-attachment plane which is an imaginary plane. The coupling portion couples the abutment portion and the body portion to each other. In a plane in parallel to the board-attachment plane, a boundary between the coupling portion and the body portion is apart from the abutment portion. The coupling portion is separable from the body portion at the boundary between the coupling portion and the body portion.

As described above, the connector body and the spacing member of the connector device of Patent Document 1 correspond to the body portion and the auxiliary portion of an aspect of the present invention, respectively. The end of the spacing member corresponds to the abutment portion of an aspect of the present invention. The surface of the board on which the connector device is mounted corresponds to the board-attachment plane.

The spacing member of the connector device of Patent Document 1 extends straight down from the connector body. Therefore, according to Patent Document 1, the position of the boundary between the connector body and the spacing member is same as the position of the end of the spacing member in a plane in parallel to the board-attachment plane. In contrast, according to an aspect of the present invention, the boundary between the body portion and the coupling portion of the auxiliary portion is apart from the abutment portion in a plane in parallel to the board-attachment plane. The thus-formed solderable component of an aspect of the present invention hardly falls down in comparison with the connector device of Patent Document 1. The solderable component according to an aspect of the present invention has a structure which enables the solderable component to stably stand by itself on a board upon soldering in comparison with the connector device of Patent Document 1 even when the body portion has a tall structure.

An appreciation of the objectives of the present invention and a more complete understanding of its structure may be had by studying the following description of the preferred embodiment and by referring to the accompanying drawings.

Figure 1:
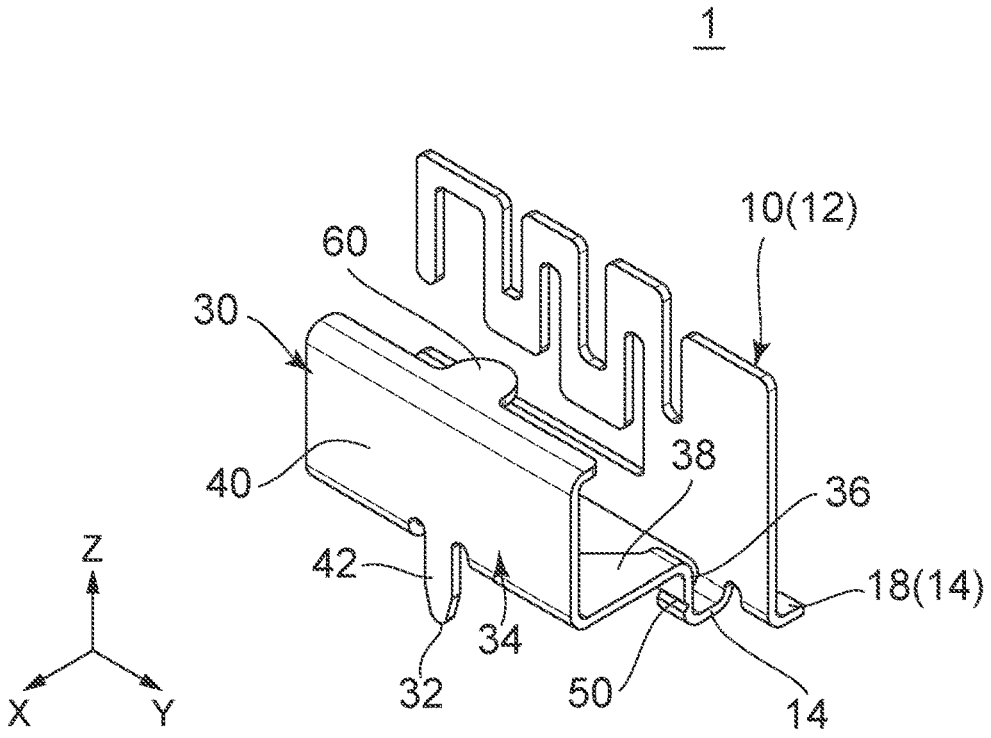
FIG. 1 is a perspective view showing a solderable component according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
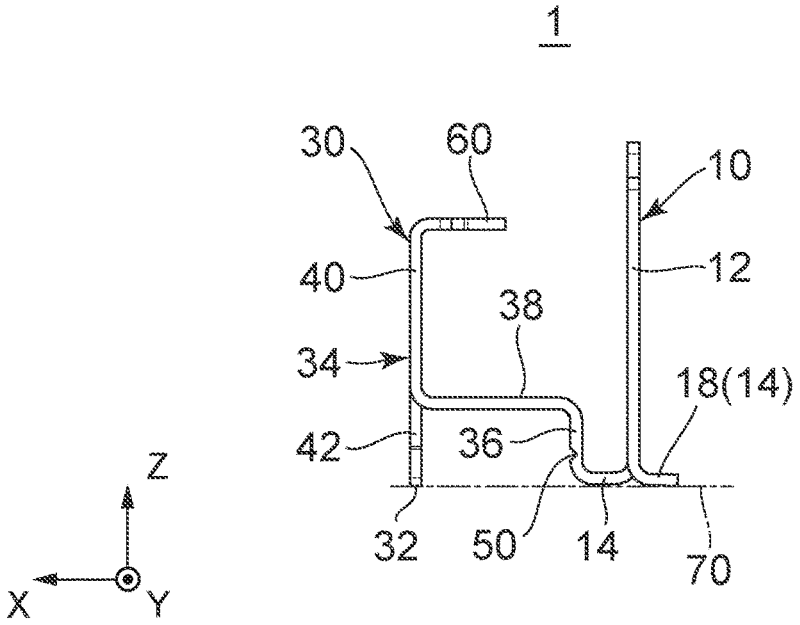
FIG. 2 is a side view showing the solderable component of FIG. 1.
Figure 3:
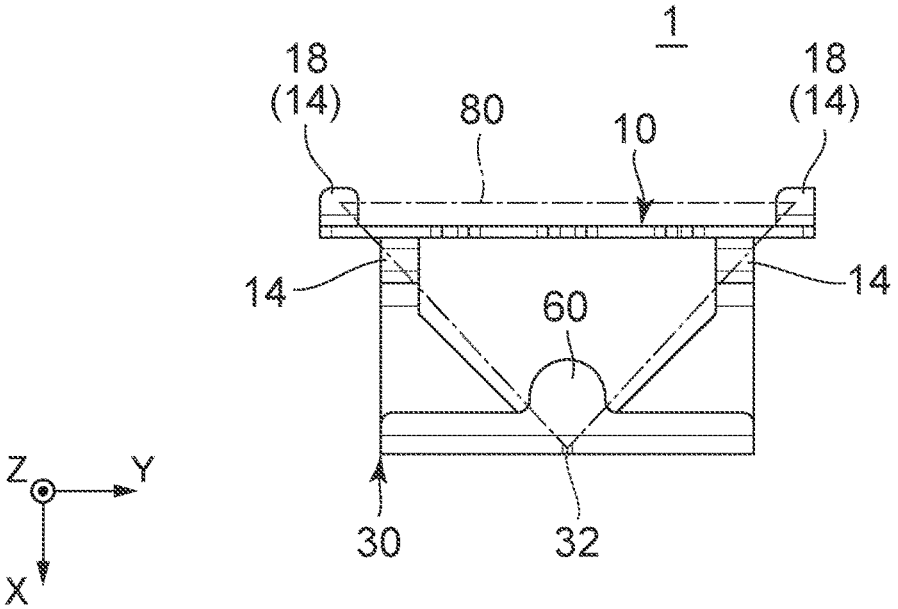
FIG. 3 is a top view showing the solderable component of FIG. 1.

Referring to FIGS. 1 to 3, a solderable component 1 according to a first embodiment of the present invention is made by pressing and bending one metal plate. Thus, the solderable component 1 of the present embodiment is formed of a single metal plate. However, the present invention is not limited thereto. The solderable component 1 may be formed of a plurality of metal components or may be formed of combined materials different from each other.

Figure 4:
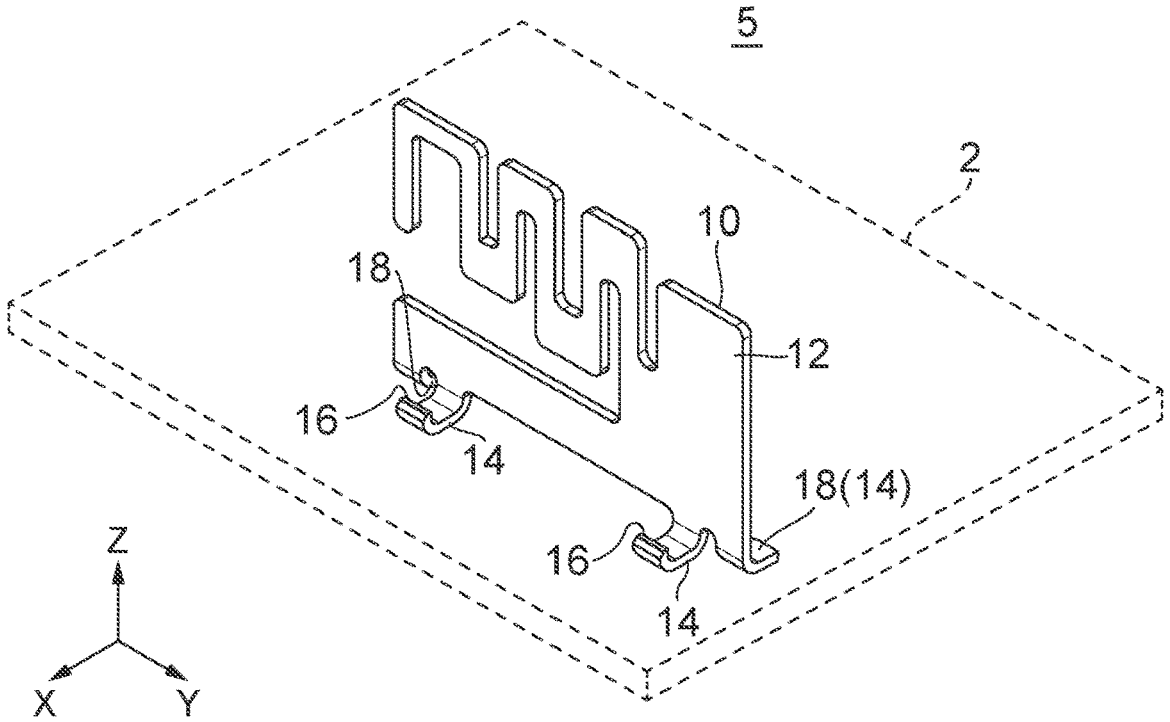
FIG. 4 is a perspective view showing a board assembly according to the first embodiment of the present invention.

Referring to FIGS. 1 and 4, the solderable component 1 of the present embodiment comprises a body portion 10 configured to be mounted on a board 2 and an auxiliary portion 30 extending from the body portion 10.

Referring to FIGS. 1 to 4, the body portion 10 has a main portion 12 and at least two solderable portions 14. The solderable portions 14 extend from the main portion 12. The body portion 10 of the present embodiment has a total of four of the solderable portions 14 which include two predetermined solderable portions 18. Thus, in the present embodiment, the number of the solderable portions 14 excluding the predetermined solderable portions 18 is two. However, the present invention is not limited thereto. The body portion 10 may have no solderable portion 14 except for the two predetermined solderable portions 18. Instead, the body portion 10 may have one, three or more of the solderable portions 14, each of which is not the predetermined solderable portion 18, in addition to the two predetermined solderable portions 18.

As shown in FIG. 1, the body portion 10 is an electrical component. More specifically, the body portion 10 of the present embodiment is an antenna. However, the present invention is not limited thereto. For example, the body portion 10 may be an electrical component other than an antenna or may be an electronic component.

As shown in FIGS. 1 and 2, the auxiliary portion 30 of the present embodiment has one abutment portion 32, a coupling portion 34 and a flat-plate portion 60. The coupling portion 34 couples the abutment portion 32 and the body portion 10 to each other. The flat-plate portion 60 extends from the coupling portion 34.

In the present embodiment, a boundary between the coupling portion 34 and the body portion 10 is provided with separation portions 50. As can be seen from FIGS. 1, 2 and 4, the separation portions 50 are used for cutting out the auxiliary portion 30 from the body portion 10 after the body portion 10 is soldered on the board 2. In other words, the auxiliary portion 30 is separable from the body portion 10 at a boundary between the auxiliary portion 30 and the body portion 10. More specifically, the coupling portion 34 is separable from the body portion 10 at the boundary between the coupling portion 34 and the body portion 10. The separation portions 50 of the present embodiment are provided at two positions.

The auxiliary portion 30 illustrated in FIGS. 1 and 2 extends from the solderable portions 14 of the body portion 10. Each of the separation portions 50 is provided on a boundary between the auxiliary portion 30 and the solderable portion 14. In particular, each of the separation portions 50 of the present embodiment is provided on the boundary between the auxiliary portion 30 and the solderable portion 14 which is not the predetermined solderable portion 18.

As shown in FIGS. 1 and 2, each of the separation portions 50 of the present embodiment is a notch or a V-groove. As can be seen from FIGS. 1, 2 and 4, a board assembly 5 can be obtained as described below. First, the solderable portions 14 are soldered on the board 2. Then, the auxiliary portion 30 is turned about the separation portions 50 so that the solderable component 1 is divided at the separation portions 50. As a result, the auxiliary portion 30 is separated from the body portion 10, and thereby the board assembly 5 is formed. Each of the separation portions 50 is not limited to a notch. For example, each of the separation portions 50 may be formed of a half-cut or may have another structure which can be easily cut.

When the auxiliary portion 30 and the body portion 10 are separated from each other by using the separation portions 50 of FIG. 2, the soldered body portion 10 is formed with remaining portions 16 each having a broken-off trace as shown in FIG. 4. The thus-formed board assembly 5 of FIG. 4 comprises the board 2 and the body portion 10. The body portion 10 has the main portion 12, the at least two solderable portions 14 and the remaining portions 16 each having the broken-off trace. The at least two solderable portions 14 extend from the main portion 12 and are soldered on the board 2.

Referring to FIGS. 1 and 2, the coupling portion 34 of the present embodiment has two stand portions 36, a horizontal portion 38, a vertical portion 40 and a leg portion 42. The stand portions 36 extend upward from the separation portions 50 in an upper-lower direction, respectively. In the present embodiment, the upper-lower direction is the Z-direction. The positive Z-direction is an upward direction. The negative Z-direction is a downward direction. As can be seen from FIGS. 1 and 3, the two stand portions 36 are apart from each other in a width direction. In the present embodiment, the width direction is the Y-direction. The horizontal portion 38 couples the two stand portions 36 to each other in the width direction. The thus-formed horizontal portion 38 has a large size in the width direction. Moreover, the horizontal portion 38 extends forward from upper ends of the stand portions 36 in a front-rear direction. In the present embodiment, the front-rear direction is the X-direction. The positive X-direction means forward. The negative X-direction means rearward. The vertical portion 40 extends upward from a front end of the horizontal portion 38. The leg portion 42 extends downward from a part of the vertical portion 40 which is located at a lower end of the vertical portion 40 and is located at the middle of the vertical portion 40 in the width direction. The abutment portion 32 is provided at a lower end of the leg portion 42. As can be seen from FIGS. 1 and 3, the abutment portion 32 is located between the two separation portions 50 in the width direction and is located at a position different from those of the separation portions 50 in the front-rear direction. The flat-plate portion 60 extends rearward from an upper end of the vertical portion 40. The flat-plate portion 60 is a part which is used when the solderable component 1 is vacuum-sucked in a vacuum transfer device. The upper-lower direction, the front-rear direction and the width direction described above are perpendicular to each other.

As can be seen from FIGS. 1 and 2, the abutment portion 32 and lower ends of the two predetermined solderable portions 18 define a board-attachment plane 70 which is an imaginary plane. The board-attachment plane 70 of the present embodiment is a plane in parallel to the XY-plane. Referring to FIGS. 2 and 4, the board-attachment plane 70 is flush with a surface of the board 2 when the solderable component 1 is mounted on the board 2.

When the solderable component 1 is mounted on the board 2, the abutment portion 32 is brought into contact with the board 2. In contrast, each of the solderable portions 14 which is not the predetermined solderable portion 18 is apart from the board-attachment plane 70. In other words, at least a gap is formed between the board-attachment plane 70 and each of the solderable portions 14 which is not the predetermined solderable portion 18. Thus, when the solderable component 1 is mounted on the board 2, the solderable component 1 is in contact with the board 2 at only three points consisting of the lower ends of the two predetermined solderable portions 18 and the abutment portion 32. The thus-arranged solderable component 1 can stand by itself on the board 2 without wobbling.

Referring to FIGS. 1 to 3, the separation portions 50 are apart from the abutment portion 32 in the XY-plane. In other words, the boundary between the coupling portion 34 and the body portion 10 is apart from the abutment portion 32 in a plane in parallel to the board-attachment plane 70.

Figure 30:
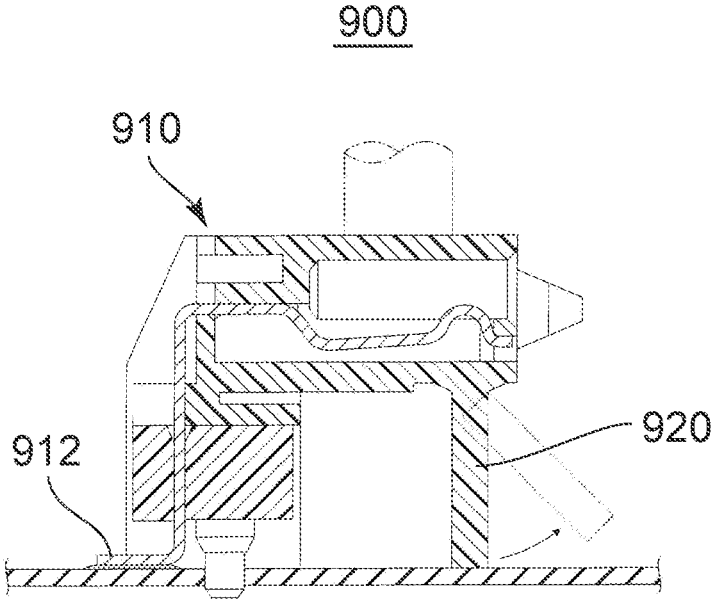
FIG.30 PRIOR ART
FIG. 30 is a cross-sectional view showing a connector device of Patent Document 1.

Since the boundary between the coupling portion 34 and the body portion 10 is apart from the abutment portion 32, the auxiliary portion 30 is not brought into abutment with the board 2 during a process in which the auxiliary portion 30 is turned to be separated from the body portion 10 at the separation portions 50. In contrast, the spacing member 920 of Patent Document 1 illustrated in FIG. 30 extends straight down from a boundary between the spacing member 920 and the connector body 910 to be in contact with a board. Since the thus-arranged spacing member 920 is brought into abutment with the board during a process in which the spacing member 920 is turned, the separation operation of the spacing member 920 cannot be performed smoothly.

Moreover, each of the aforementioned separation portions 50 is provided on the boundary between the auxiliary portion 30 and the solderable portion 14 which is not the predetermined solderable portion 18. This arrangement reduces the stress which is applied to the body portion 10 when the auxiliary portion 30 is turned to be separated from the body portion 10 at the separation portions 50. As a result, plastic deformation of the body portion 10 can be prevented.

Hereafter, "predetermined plane" means a plane which includes the center of gravity of the solderable component 1 and two of the three points consisting of the two predetermined solderable portions 18 and the abutment portion 32. The smaller is an angle between the predetermined plane and the board-attachment plane 70, the less likely the solderable component 1 falls down.

As described above, each of the separation portions 50 of the present embodiment, i.e. the boundary between the coupling portion 34 and the body portion 10, is apart from the abutment portion 32 in a plane in parallel to the board-attachment plane 70. This arrangement enables the angle between the predetermined plane and the board-attachment plane 70 to be made smaller in comparison with the connector device of Patent Document 1, for example. Thus, the solderable component 1 of the present embodiment is hard to fall down and is easy to stably stand by itself on the board 2 upon soldering even when the body portion 10 has a tall structure.

As can be seen from FIGS. 2 and 3, the lower ends of the two predetermined solderable portions 18 and the abutment portion 32 are located at vertexes of a predetermined triangle region 80 in the board-attachment plane 70, respectively. Meanwhile, the center of gravity of the solderable component 1 is located in the predetermined triangle region 80 when projected onto the board-attachment plane 70. According to this arrangement, the solderable component 1 can more stably stand by itself on the board 2.

The flat-plate portion 60 is, at least in part, located in the predetermined triangle region 80 when seen along the upper-lower direction. Thus, the center of gravity of the solderable component 1 and the flat-plate portion 60 are located close to each other when seen along the upper-lower direction. According to this arrangement, when the flat-plate portion 60 is vacuum-sucked, the solderable component 1 can be held properly.

As can be seen from FIGS. 2 and 3, the auxiliary portion 30 is, at least in part, located outside the body portion 10 in a plane in parallel to the board-attachment plane 70. In detail, when the body portion 10 is projected onto a region of the board-attachment plane 70, a part of the auxiliary portion 30 which includes the abutment portion 32 is located out of a region which the body portion 10 occupies. As can be seen from FIGS. 1 and 4, by removing the auxiliary portion 30 after soldering, only the body portion 10 having a small mounting area is left on the board 2.

As can be seen from FIGS. 1, 2 and 4, since the coupling portion 34 has the stand portions 36, some parts such as the horizontal portion 38 of the coupling portion 34 are apart from the board 2 under a state where the solderable component 1 is mounted on the board 2. Therefore, a region on the board 2 which is located under the coupling portion 34 can be used for some purpose.

Second Embodiment

Summarizing with reference to FIGS. 1 to 3 and FIGS. 5 to 7, a solderable component 1A according to a second embodiment of the present invention is different from the solderable component 1 of the first embodiment in the number of the separation portions 50 and the number of the separation portion 50A. Specifically, the number of the separation portions 50 of the solderable component 1 of the first embodiment is two. On the other hand, the number of separation portion 50A of the solderable component 1A of the present embodiment is one. Hereafter, specific explanation will be made about the solderable component 1A of the present embodiment. However, explanation will not be made about configurations similar to those of the solderable component 1 of the first embodiment.

Figure 5:
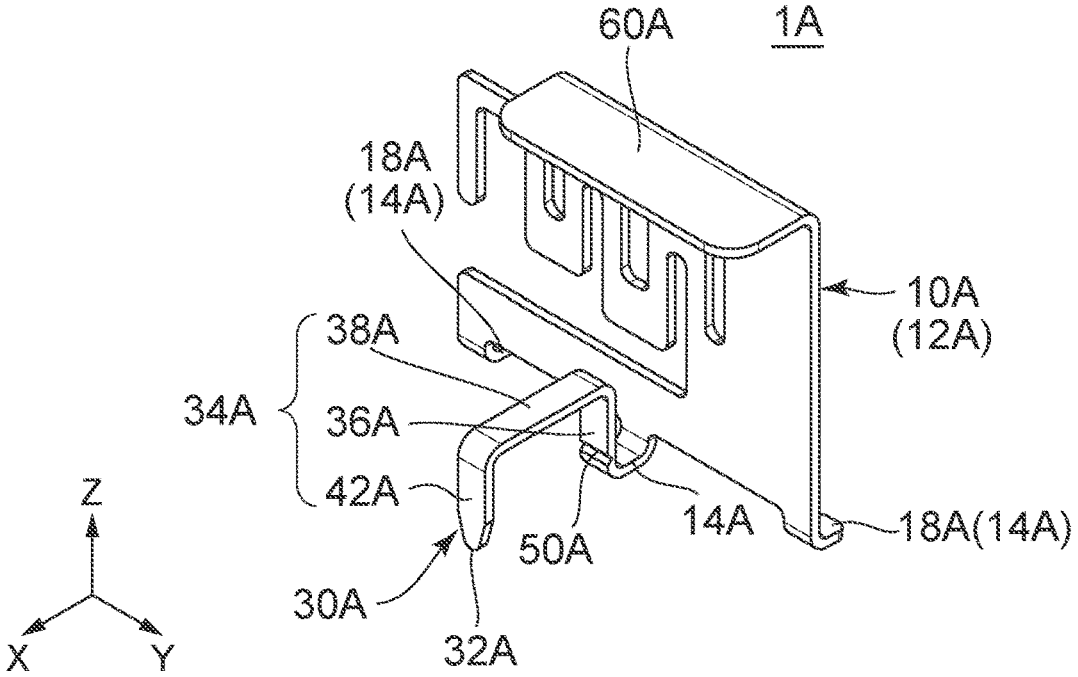
FIG. 5 is a perspective view showing a solderable component according to a second embodiment of the present invention.
Figure 6:
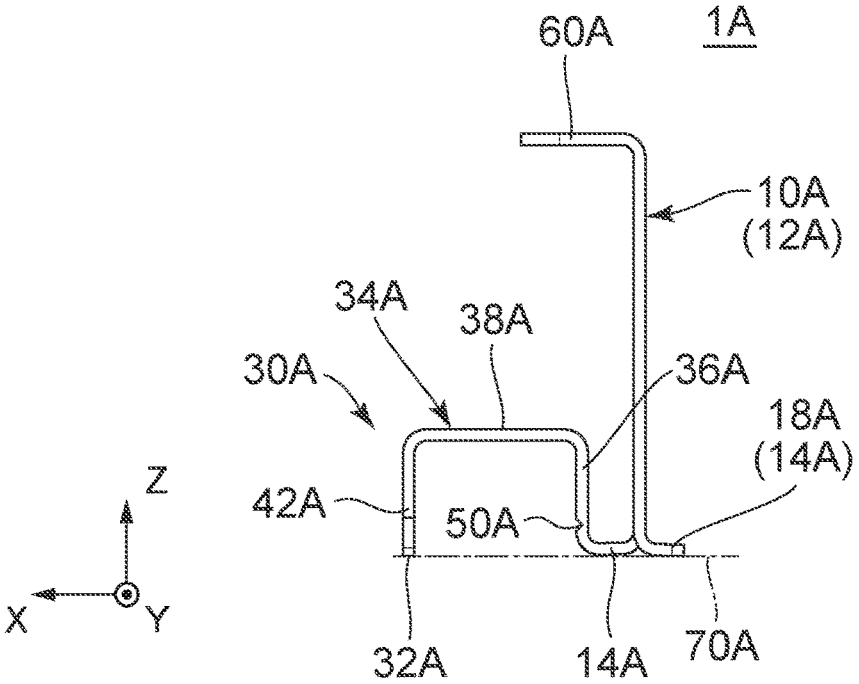
FIG. 6 is a side view showing the solderable component of FIG. 5.
Figure 7:
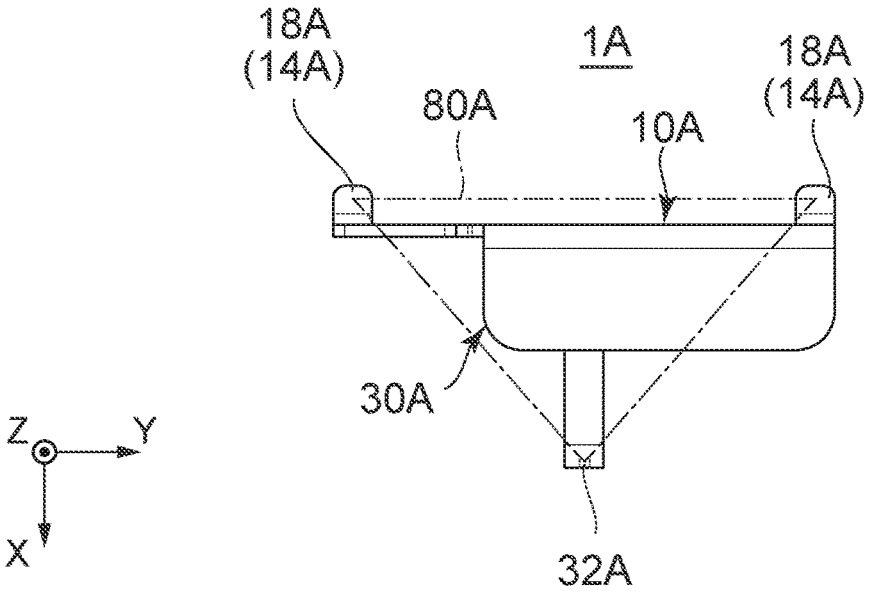
FIG. 7 is a top view showing the solderable component of FIG. 5.
Figure 8:
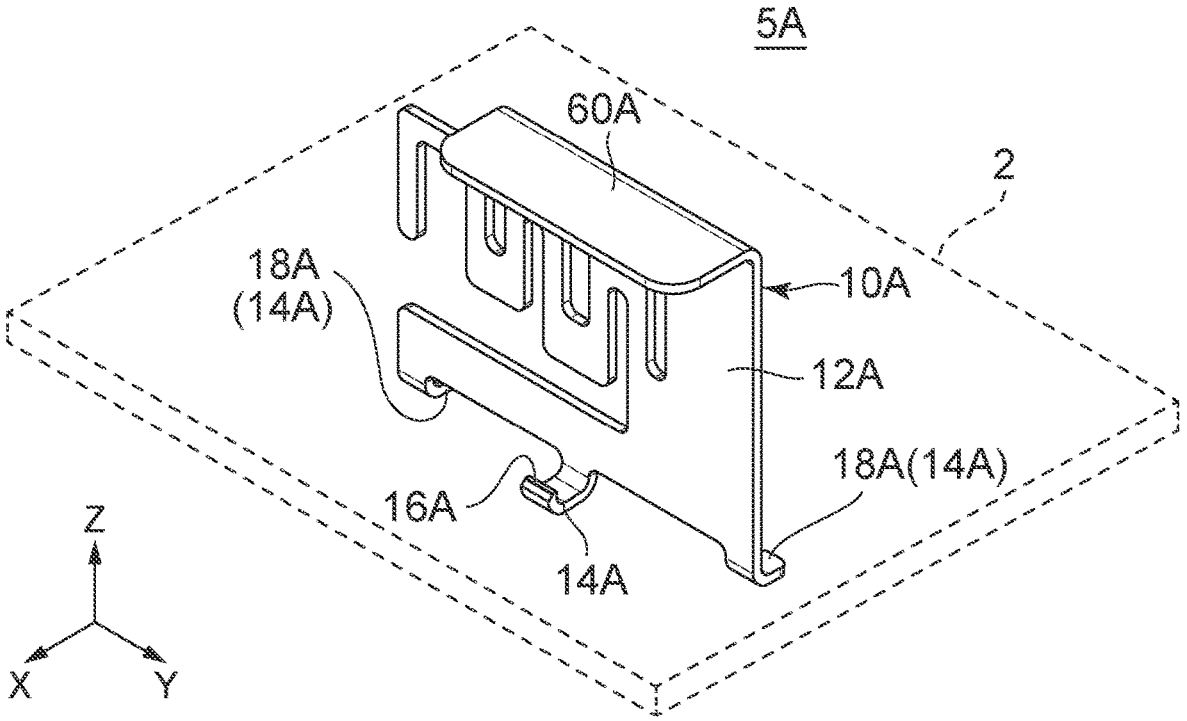
FIG. 8 is a perspective view showing a board assembly according to the second embodiment of the present invention.

Referring to FIGS. 5 to 7, the solderable component 1A of the second embodiment of the present invention is formed of a single metal plate. Referring to FIGS. 5 and 8, the solderable component 1A of the present embodiment comprises a body portion 10A configured to be mounted on the board 2 and an auxiliary portion 30A extending from the body portion 10A.

Referring to FIGS. 5 to 8, the body portion 10A has a main portion 12A, at least two solderable portions 14A and a flat-plate portion 60A extending from the main portion 12A. The solderable portions 14A extend from the main portion 12A. The body portion 10A of the present embodiment has a total of three of the solderable portions 14A which include two predetermined solderable portions 18A. The two predetermined solderable portions 18A are provided in the vicinities of opposite ends of the main portion 12A in a width direction. The solderable portion 14A which is not the predetermined solderable portion 18A is provided at the middle of the main portion 12A in the width direction. In the present embodiment, the width direction is the Y-direction.

As described above, the flat-plate portion 60A of the present embodiment is provided not on the auxiliary portion 30A but on the body portion 10A. The flat-plate portion 60A is a part which is used when the solderable component 1A is vacuum-sucked in a vacuum transfer device. The flat-plate portion 60A of the present embodiment extends rearward from an upper end of the body portion 10A. In the present embodiment, an upper-lower direction is the Z-direction. The positive Z-direction is an upward direction. The negative Z-direction is a downward direction. In the present embodiment, a front-rear direction is the X-direction. The positive X-direction means forward. The negative X-direction means rearward. The upper-lower direction, the front-rear direction and the width direction described above are perpendicular to each other.

As shown in FIG. 5, the body portion 10A is an electrical component. More specifically, the body portion 10A of the present embodiment is an antenna.

As shown in FIGS. 5 and 6, the auxiliary portion 30A of the present embodiment has one abutment portion 32A and a coupling portion 34A. The coupling portion 34A couples the abutment portion 32A and the body portion 10A to each other.

In the present embodiment, a boundary between the coupling portion 34A and the body portion 10A is provided with the separation portion 50A. As can be seen from FIGS. 5, 6 and 8, the separation portion 50A is used for cutting out the auxiliary portion 30A from the body portion 10A after the body portion 10A is soldered on the board 2. In other words, the auxiliary portion 30A is separable from the body portion 10A at a boundary between the auxiliary portion 30A and the body portion 10A. More specifically, the coupling portion 34A is separable from the body portion 10A at the boundary between the coupling portion 34A and the body portion 10A. The separation portion 50A of the present embodiment is provided at one position.

More specifically, the auxiliary portion 30A illustrated in FIGS. 5 and 6 extends from the solderable portion 14A of the body portion 10A. The separation portion 50A is provided on a boundary between the auxiliary portion 30A and the solderable portion 14A. In particular, the separation portion 50A of the present embodiment is provided on the boundary between the auxiliary portion 30A and the solderable portion 14A which is not the predetermined solderable portion 18A.

As shown in FIGS. 5 and 6, the separation portion 50A of the present embodiment is a notch or a V-groove. As can be seen from FIGS. 5, 6 and 8, a board assembly 5A can be obtained as described below. First, the solderable portions 14A are soldered on the board 2. Then, the auxiliary portion 30A is turned about the separation portion 50A so that the solderable component 1A is divided at the separation portion 50A. As a result, the auxiliary portion 30A is separated from the body portion 10A, and thereby the board assembly 5A is formed.

When the auxiliary portion 30A and the body portion 10A are separated from each other by using the separation portion 50A of FIG. 6, the soldered body portion 10A is formed with a remaining portion 16A having a broken-off trace as shown in FIG. 8. The thus-formed board assembly 5A of FIG. 8 comprises the board 2 and the body portion 10A. The body portion 10A has the main portion 12A, the at least two solderable portions 14A and the remaining portion 16A having the broken-off trace. The at least two solderable portions 14A extend from the main portion 12A and are soldered on the board 2.

Referring to FIGS. 5 and 6, the coupling portion 34A of the present embodiment has a stand portion 36A, a horizontal portion 38A and a leg portion 42A. The stand portion 36A extends upward from the separation portion 50A in the upper-lower direction. The horizontal portion 38A extends forward from an upper end of the stand portion 36A in the front-rear direction. The leg portion 42A extends downward from a front end of the horizontal portion 38A. The abutment portion 32A is provided at a lower end of the leg portion 42A. As can be seen from FIGS. 5 and 7, the abutment portion 32A is located at a position which overlaps with the separation portion 50A in the width direction.

As can be seen from FIGS. 5 and 6, the abutment portion 32A and lower ends of the two predetermined solderable portions 18A define a board-attachment plane 70A which is an imaginary plane. The board-attachment plane 70A of the present embodiment is a plane in parallel to the XY-plane. Referring to FIGS. 6 and 8, the board-attachment plane 70A is flush with a surface of the board 2 when the solderable component 1A is mounted on the board 2.

When the solderable component 1A is mounted on the board 2, the abutment portion 32A is brought into contact with the board 2. In contrast, the solderable portion 14A which is not the predetermined solderable portion 18A is apart from the board-attachment plane 70A. In other words, at least a gap is formed between the board-attachment plane 70A and the solderable portion 14A which is not the predetermined solderable portion 18A. Thus, when the solderable component 1A is mounted on the board 2, the solderable component 1A is in contact with the board 2 at only three points consisting of the lower ends of the two predetermined solderable portions 18A and the abutment portion 32A. The thus-arranged solderable component 1A can stand by itself on the board 2 without wobbling.

Referring to FIGS. 5 to 7, the separation portion 50A is apart from the abutment portion 32A in the XY-plane. In other words, the boundary between the coupling portion 34A and the body portion 10A is apart from the abutment portion 32A in a plane in parallel to the board-attachment plane 70A. The thus-arranged auxiliary portion 30A is not brought into abutment with the board 2 when the auxiliary portion 30A is turned to be separated from the body portion 10A at the separation portion 50A.

Moreover, the aforementioned separation portion 50A is provided on the boundary between the auxiliary portion 30A and the solderable portion 14A which is not the predetermined solderable portion 18A. This arrangement reduces the stress which is applied to the predetermined solderable portions 18A when the auxiliary portion 30A is turned to be separated from the body portion 10A at the separation portion 50A.

As described above, the separation portion 50A of the present embodiment, i.e. the boundary between the coupling portion 34A and the body portion 10A, is apart from the abutment portion 32A in a plane in parallel to the board-attachment plane 70A. According to this arrangement, the solderable component 1A of the present embodiment is hard to fall down and is easy to stably stand by itself on the board 2 upon soldering even when the body portion 10A has a tall structure.

As can be seen from FIGS. 6 and 7, the lower ends of the two predetermined solderable portions 18A and the abutment portion 32A are located at vertexes of a predetermined triangle region 80A in the board-attachment plane 70A, respectively. Meanwhile, the center of gravity of the solderable component 1A is located in the predetermined triangle region 80A when projected onto the board-attachment plane 70A. According to this arrangement, the solderable component 1A can more stably stand by itself on the board 2.

The flat-plate portion 60A is, at least in part, located in the predetermined triangle region 80A when seen along the upper-lower direction. Thus, the center of gravity of the solderable component 1A and the flat-plate portion 60A are located close to each other when seen along the upper-lower direction. According to this arrangement, when the flat-plate portion 60A is vacuum-sucked, the solderable component 1A can be held properly.

As can be seen from FIGS. 6 and 7, the auxiliary portion 30A is, at least in part, located outside the body portion 10A in a plane in parallel to the board-attachment plane 70A. In detail, when the body portion 10A is projected onto a region of the board-attachment plane 70A, a part of the auxiliary portion 30A which includes the abutment portion 32A is located out of a region which the body portion 10A occupies. As can be seen from FIGS. 5 and 8, by removing the auxiliary portion 30A after soldering, only the body portion 10A having a small mounting area is left on the board 2.

As can be seen from FIGS. 5, 6 and 8, since the coupling portion 34A has the stand portion 36A, some parts such as the horizontal portion 38A of the coupling portion 34A are apart from the board 2 under a state where the solderable component 1A is mounted on the board 2. Therefore, a region on the board 2 which is located under the coupling portion 34A can be used for some purpose.

Third Embodiment

Summarizing with reference to FIGS. 1 to 3 and FIGS. 9 to 12, a solderable component 1B according to a third embodiment of the present invention is different from the solderable component 1 of the first embodiment in the arrangement of the separation portions 50 and the arrangement of the separation portions 50B. Specifically, the separation portions 50 of the solderable component 1 of the first embodiment are located in the vicinity of a lower end of the body portion 10 in the upper-lower direction. In contrast, the separation portions 50B of the solderable component 1B of the present embodiment are located in the vicinity of an upper end of a body portion 10B in an upper-lower direction. In the present embodiment, the upper-lower direction is the Z-direction. The positive Z-direction is an upward direction. The negative Z-direction is a downward direction. Hereafter, specific explanation will be made about the solderable component 1B of the present embodiment. However, explanation will not be made about configurations similar to those of the solderable component 1 of the first embodiment.

Figure 9:
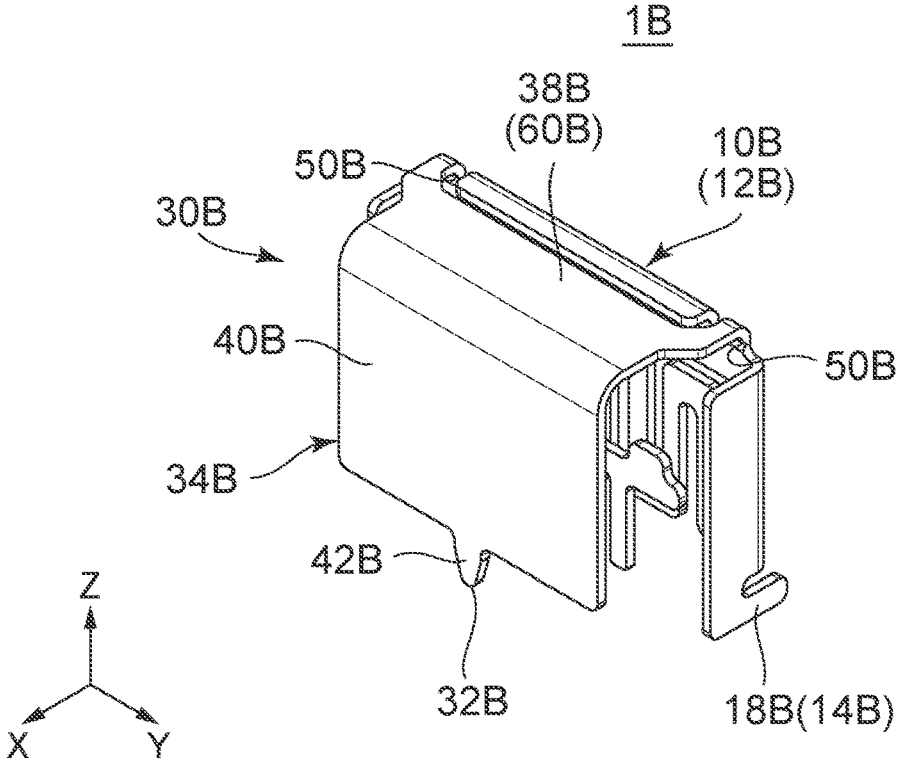
FIG. 9 is a perspective view showing a solderable component according to a third embodiment of the present invention.
Figure 10:
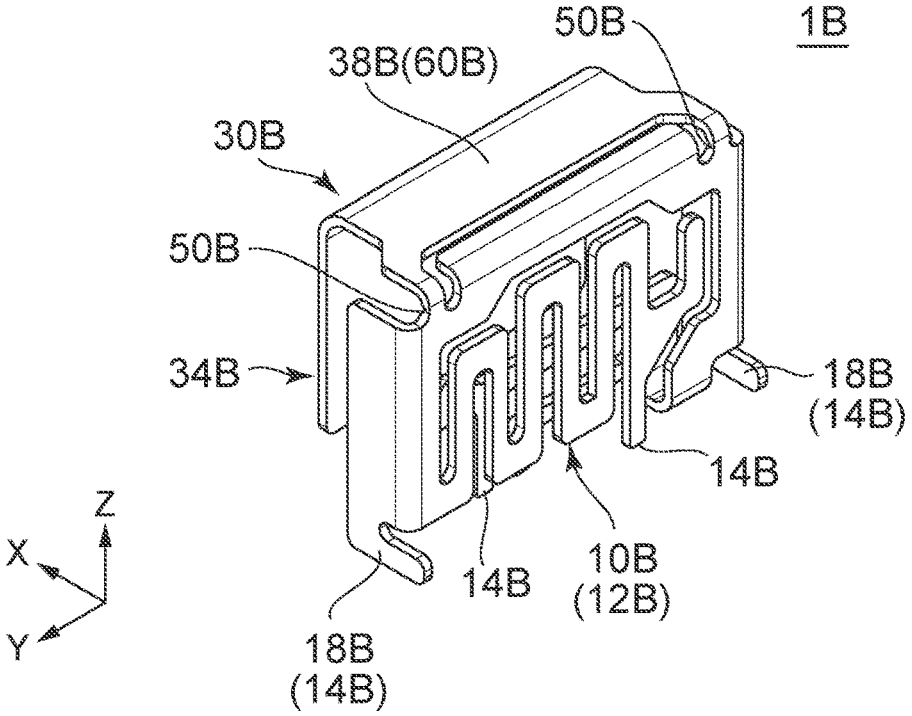
FIG. 10 is another perspective view showing the solderable component of FIG. 9.

Referring to FIGS. 9 to 12, the solderable component 1B of the third embodiment of the present invention is formed of a single metal plate. Referring to FIGS. 9, 10 and 13, the solderable component 1B of the present embodiment comprises the body portion 10B configured to be mounted on the board 2 and the auxiliary portion 30B extending from the body portion 10B.

Referring to FIGS. 9 to 13, the body portion 10B has a main portion 12B and at least two solderable portions 14B. The solderable portions 14B extend from the main portion 12B. The body portion 10B of the present embodiment has a total of five of the solderable portions 14 including two predetermined solderable portions 18B. Thus, in the present embodiment, the number of the solderable portions 14B excluding the predetermined solderable portions 18B is three. The predetermined solderable portions 18B of the present embodiment are two of the solderable portions 14B each of which is located at an outermost position in a width direction. In the present embodiment, the width direction is the Y-direction.

As shown in FIG. 10, the body portion 10B is an electrical component. More specifically, the body portion 10B of the present embodiment is an antenna.

As shown in FIG. 9, the auxiliary portion 30B of the present embodiment has one abutment portion 32B and a coupling portion 34B. The coupling portion 34B couples the abutment portion 32B and the body portion 10B to each other.

In the present embodiment, a boundary between the coupling portion 34B and the body portion 10B is provided with the separation portions 50B. As can be seen from FIGS. 9 to 11 and 13, the separation portions 50B are used for cutting out the auxiliary portion 30B from the body portion 10B after the body portion 10B is soldered on the board 2. In other words, the auxiliary portion 30B is separable from the body portion 10B at a boundary between the auxiliary portion 30B and the body portion 10B. More specifically, the coupling portion 34B is separable from the body portion 10B at the boundary between the coupling portion 34B and the body portion 10B. The separation portions 50B of the present embodiment are provided at two positions. As can be seen from FIGS. 9 and 10, the two separation portions 50B are apart from each other in the width direction.

More specifically, the auxiliary portion 30B illustrated in FIGS. 9 and 10 extends from positions which are located in the vicinity of an upper end of the body portion 10B. Each of the separation portions 50B is provided on the boundary between the auxiliary portion 30B and the body portion 10B. In detail, each of the separation portions 50B is provided on a boundary between the auxiliary portion 30B and the main portion 12B. As can be seen from the explanation described above, each of the separation portions 50B of the present embodiment is nearer to the upper end of the body portion 10B than to a lower end of the body portion 10B.

As shown in FIGS. 9 and 10, each of the separation portions 50B of the present embodiment is a notch or a V-groove. As can be seen from FIGS. 9 to 11 and 13, a board assembly 5B can be obtained as described below. First, the solderable portions 14B are soldered on the board 2. Then, the auxiliary portion 30B is turned about the separation portions 50B so that the solderable component 1B is divided at the separation portions 50B. As a result, the auxiliary portion 30B is separated from the body portion 10B, and thereby the board assembly 5B is formed.

As described above, the separation portions 50B of the present embodiment are nearer to the upper and of the body portion 10B than to the lower end of the body portion 10B. In the present embodiment, when the solderable component 1B is seen along the width direction, the auxiliary portion 30B is entirely located outside an imaginary circle which is centered on the separation portion 50B and passes the upper end of the body portion 10B. This arrangement prevents the auxiliary portion 30B from being brought into abutment with the body portion 10B when the auxiliary portion 30B is turned about the separation portions 50B.

When the auxiliary portion 30B and the body portion 10B are separated from each other by using the separation portions 50B of FIGS. 9 and 10, the soldered body portion 10B is formed with remaining portions 16B each having a broken-off trace as shown in FIG. 13. The thus-formed board assembly 5B of FIG. 13 comprises the board 2 and the body portion 10B. The body portion 10B has the main portion 12B, the at least two solderable portions 14B and the remaining portions 16B each having the broken-off trace. The at least two solderable portions 14B extend from the main portion 12B and are soldered on the board 2.

Referring to FIGS. 9 and 10, the coupling portion 34B of the present embodiment has a horizontal portion 38B, a vertical portion 40B and a leg portion 42B. The horizontal portion 38B is located above the two separation portions 50B and couples the two separation portions 50B to each other. The horizontal portion 38B extends forward in a front-rear direction. In the present embodiment, the front-rear direction is the X-direction. The positive X-direction means forward. The negative X-direction means rearward. The upper-lower direction, the front-rear direction and the width direction described above are perpendicular to each other.

Since the horizontal portion 38B couples the two separation portions 50B to each other in the width direction as described above, the horizontal portion 38B has a large size in the width direction. In the present embodiment, the large horizontal portion 38B also works as a flat-plate portion 60B which is used when the solderable component 1B is vacuum-sucked in a vacuum transfer device. The vertical portion 40B extends downward from a front end of the horizontal portion 38B. The leg portion 42B extends downward from a part of the vertical portion 40B which is located at a lower end of the vertical portion 40B and is located at the middle of the vertical portion 40B in the width direction. The abutment portion 32B is provided at a lower end of the leg portion 42B. As can be seen from FIGS. 9 and 10, the abutment portion 32B is located between the two separation portions 50B in the width direction and is located at a position different from those of the separation portions 50B in the front-rear direction.

Figure 11:
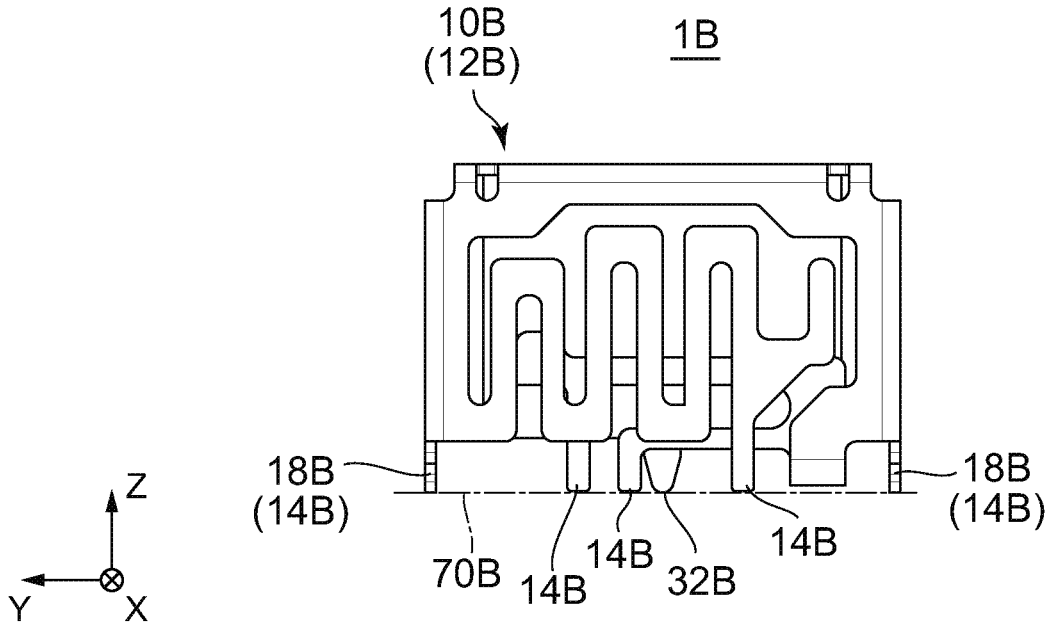
FIG. 11 is a rear view showing the solderable component of FIG. 9.

As can be seen from FIGS. 9 and 11, the abutment portion 32B and lower ends of the two predetermined solderable portions 18B define a board-attachment plane 70B which is an imaginary plane. The board-attachment plane 70B of the present embodiment is a plane in parallel to the XY-plane. Referring to FIGS. 11 and 13, the board-attachment plane 70B is flush with a surface of the board 2 when the solderable component 1B is mounted on the board 2.

When the solderable component 1B is mounted on the board 2, the abutment portion 32B is brought into contact with the board 2. In contrast, each of the solderable portions 14B which is not the predetermined solderable portion 18B is apart from the board-attachment plane 70B. In other words, at least a gap is formed between the board-attachment plane 70B and each of the solderable portions 14B which is not the predetermined solderable portion 18B. Thus, when the solderable component 1B is mounted on the board 2, the solderable component 1B is in contact with the board 2 at only three points consisting of the lower ends of the two predetermined solderable portions 18B and the abutment portion 32B. The thus-arranged solderable component 1B can stand by itself on the board 2 without wobbling.

Referring to FIGS. 9 to 12, the separation portions 50B are apart from the abutment portion 32B in the XY-plane. In other words, the boundary between the coupling portion 34B and the body portion 10B is apart from the abutment portion 32B in a plane in parallel to the board-attachment plane 70B. The thus-arranged auxiliary portion 30B is not brought into abutment with the board 2 when the auxiliary portion 30B is turned to be separated from the body portion 10B at the separation portions 50B.

As described above, each of the separation portions 50B of the present embodiment, i.e. the boundary between the coupling portion 34B and the body portion 10B, is apart from the abutment portion 32B in a plane in parallel to the board-attachment plane 70B. According to this arrangement, the solderable component 1B of the present embodiment is hard to fall down and is easy to stably stand by itself on the board 2 upon soldering even when the body portion 10B has a tall structure.

Figure 12:
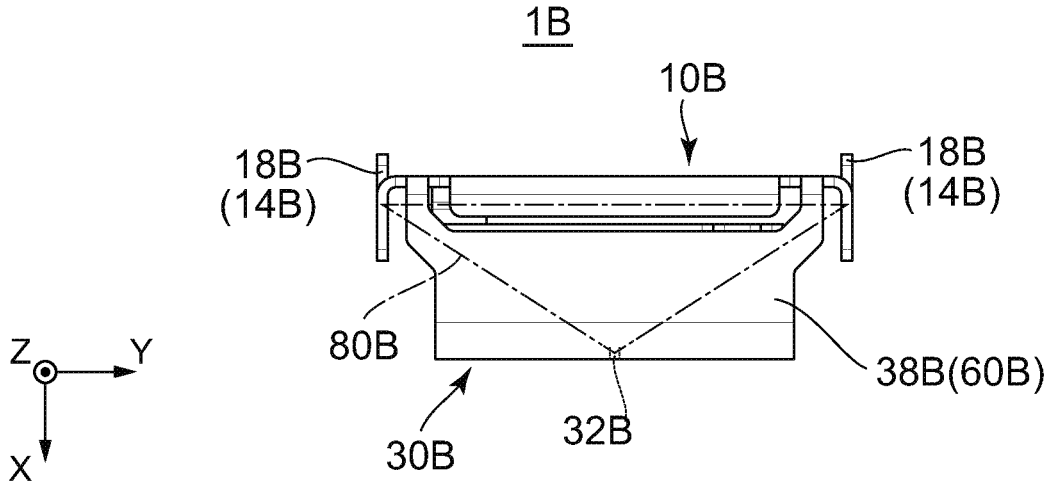
FIG. 12 is a top view showing the solderable component of FIG. 9.
Figure 13:
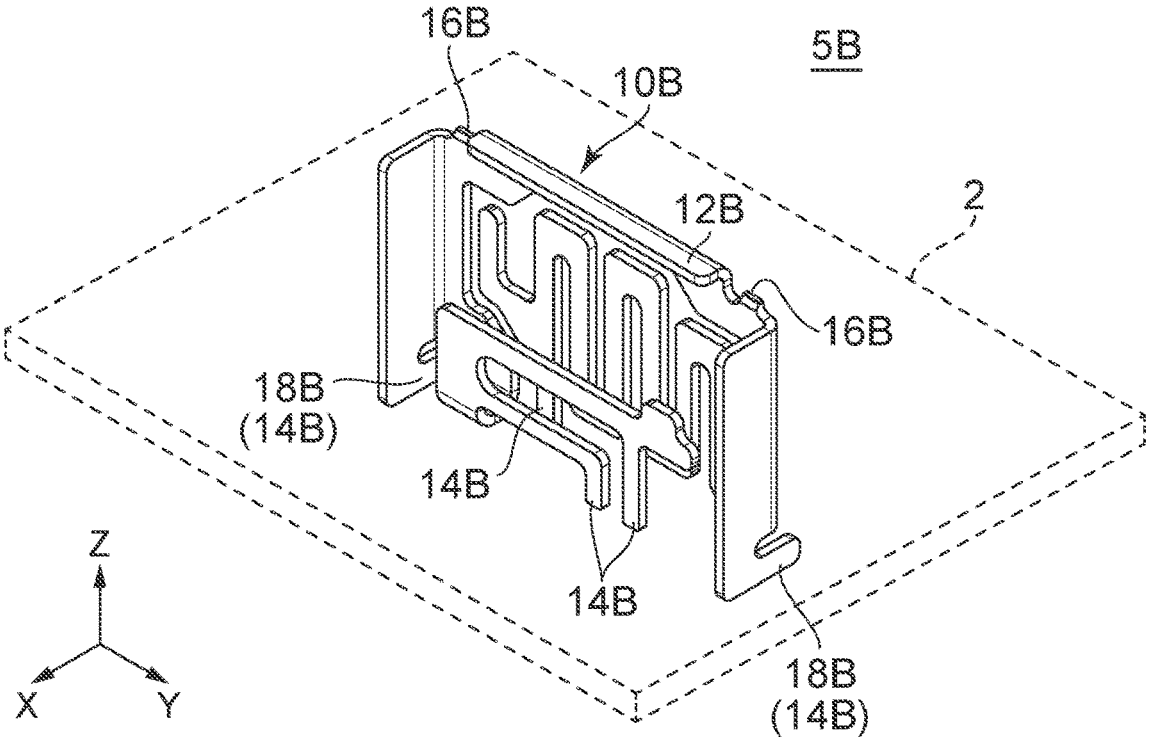
FIG. 13 is a perspective view showing a board assembly according to the third embodiment of the present invention.

As can be seen from FIGS. 11 and 12, the lower ends of the two predetermined solderable portions 18B and the abutment portion 32B are located at vertexes of a predetermined triangle region 80B in the board-attachment plane 70B, respectively. Meanwhile, the center of gravity of the solderable component 1B is located in the predetermined triangle region 80B when projected onto the board-attachment plane 70B. According to this arrangement, the solderable component 1B can more stably stand by itself on the board 2.

The flat-plate portion 60B is, at least in part, located in the predetermined triangle region 80B when seen along the upper-lower direction. Thus, the center of gravity of the solderable component 1B and the flat-plate portion 60B are located close to each other when seen along the upper-lower direction. According to this arrangement, when the flat-plate portion 60B is vacuum-sucked, the solderable component 1B can be held properly.

As can be seen from FIGS. 9, 11 and 12, the auxiliary portion 30B is, at least in part, located outside the body portion 10B in a plane in parallel to the board-attachment plane 70B. In detail, when the body portion 10B is projected onto a region of the board-attachment plane 70B, a part of the auxiliary portion 30B which includes the abutment portion 32B is located out of a region which the body portion 10B occupies. As can be seen from FIGS. 9 and 13, by removing the auxiliary portion 30B after soldering, only the body portion 10B having a small mounting area is left on the board 2.

As can be seen from FIGS. 9, 10 and 13, since the coupling portion 34B extends from the parts located in the vicinity of the upper end of the body portion 10B, some parts such as the horizontal portion 38B of the coupling portion 34B are apart from the board 2 under a state where the solderable component 1B is mounted on the board 2. Therefore, a region on the board 2 which is located under the coupling portion 34B can be used for some purpose.

Fourth Embodiment

Summarizing with reference to FIGS. 1 to 3 and FIGS. 14 to 17, a solderable component 1C according to a fourth embodiment of the present invention is different from the solderable component 1 of the first embodiment in the positional relation between the body portion 10 and the auxiliary portion 30 and the positional relation between a body portion 100 and an auxiliary portion 30C. Specifically, the body portion 10 of the solderable component 1 of the first embodiment is located substantially outside the auxiliary portion 30. In contrast, the body portion 100 of the solderable component 1C of the present embodiment is located inside the auxiliary portion 30C. Hereafter, specific explanation will be made about the solderable component 1C of the present embodiment. However, explanation will not be made about configurations similar to those of the solderable component 1 of the first embodiment.

Figure 14:
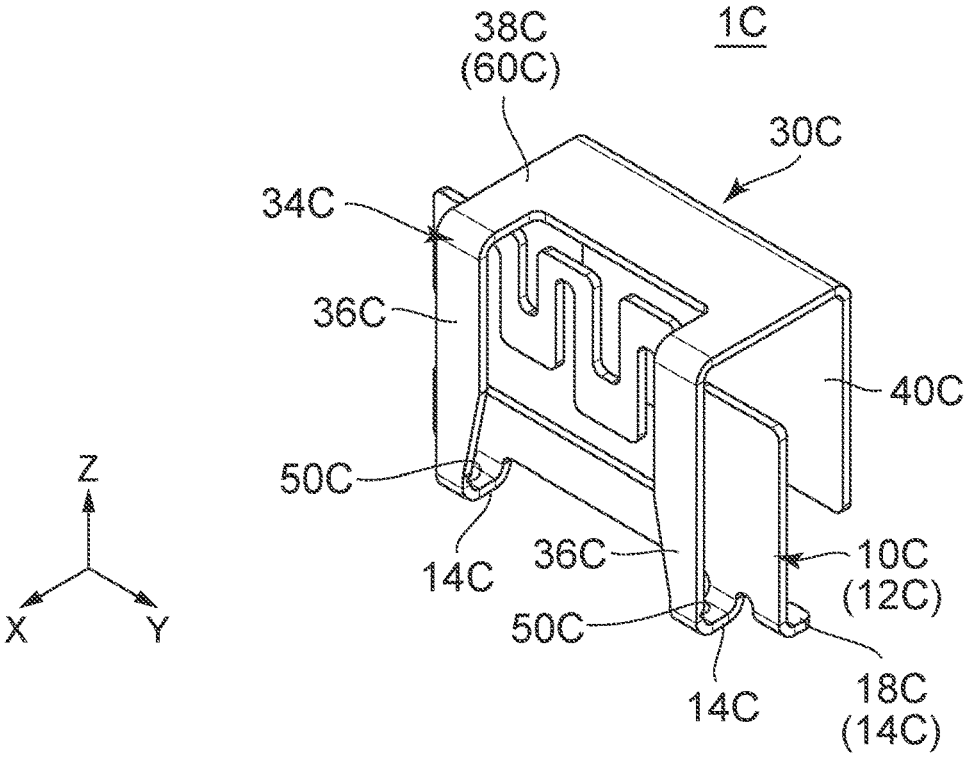
FIG. 14 is a perspective view showing a solderable component according to a fourth embodiment of the present invention.
Figure 15:
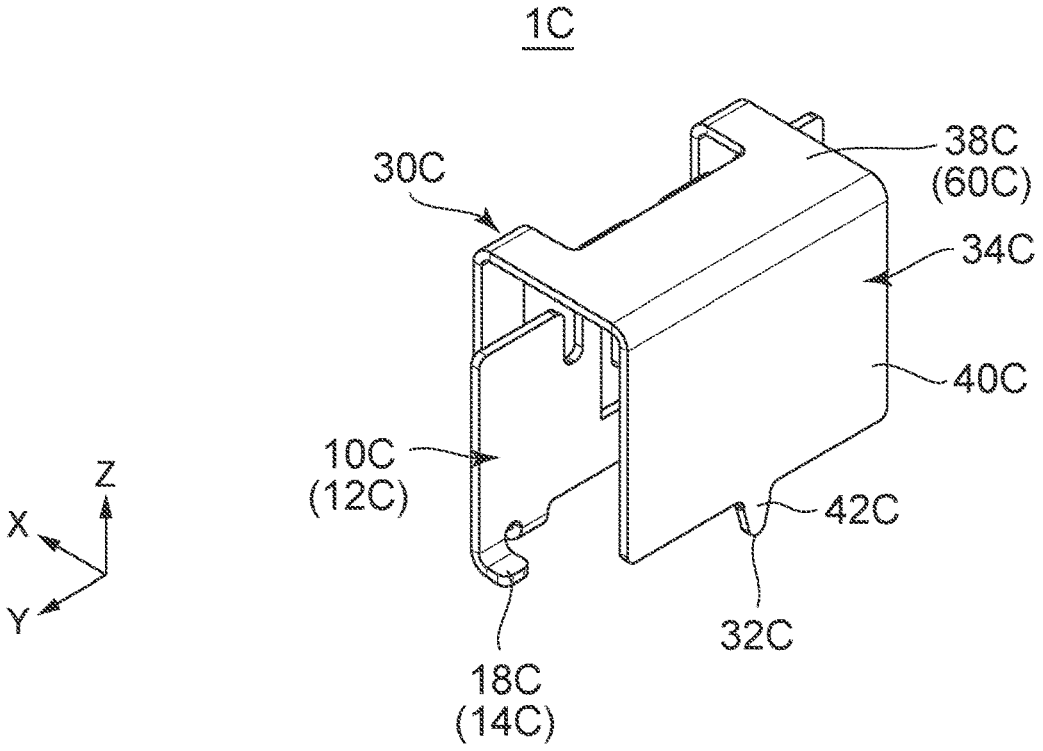
FIG. 15 is another perspective view showing the solderable component of FIG. 14.
Figure 16:
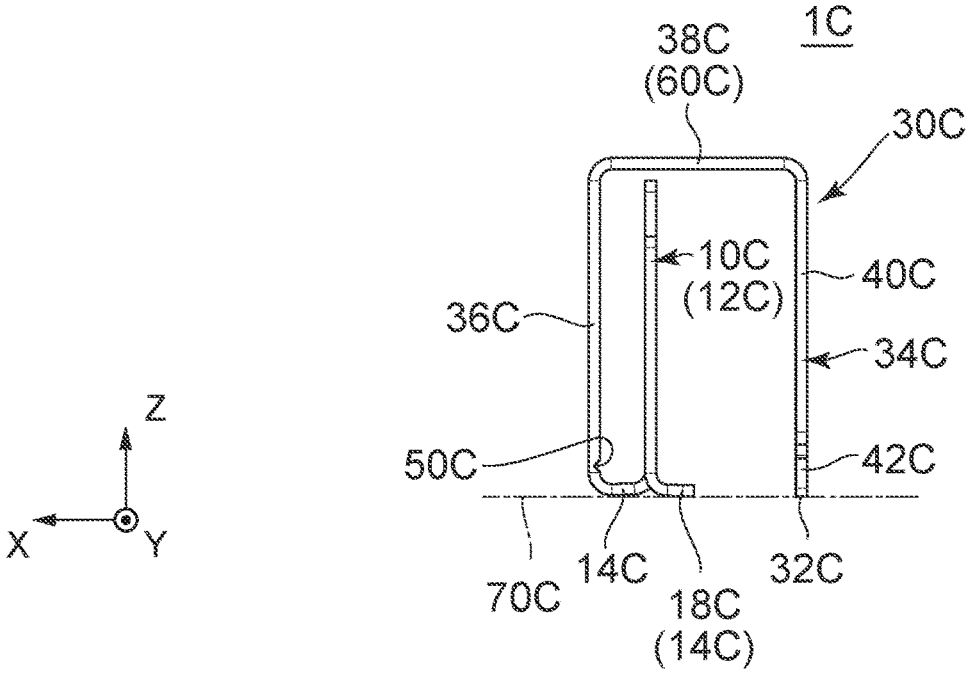
FIG. 16 is a side view showing the solderable component of FIG. 14.

Referring to FIGS. 14 to 17, the solderable component 10 of the fourth embodiment of the present invention is formed of a single metal plate. Referring to FIGS. 14, 16 and 18, the solderable component 1C of the present embodiment comprises the body portion 10C configured to be mounted on the board 2 and the auxiliary portion 30C extending from the body portion 10C.

Referring to FIGS. 14 to 18, the body portion 10C has a main portion 12C and at least two solderable portions 14C. The solderable portions 14C extend from the main portion 12C. The body portion 10C of the present embodiment has a total of four of the solderable portions 14C including two predetermined solderable portions 18C. Thus, in the present embodiment, the number of the solderable portions 14C excluding the predetermined solderable portions 18C is two.

As shown in FIG. 18, the body portion 10C is an electrical component. More specifically, the body portion 10C of the present embodiment is an antenna.

As shown in FIG. 15, the auxiliary portion 30C of the present embodiment has one abutment portion 32C and a coupling portion 34C. The coupling portion 34C couples the abutment portion 32C and the body portion 10C to each other.

As shown in FIG. 14, in the present embodiment, a boundary between the coupling portion 34C and the body portion 10C is provided with separation portions 50C. As can be seen from FIGS. 14, 16 and 18, the separation portions 50C are used for cutting out the auxiliary portion 30C from the body portion 10C after the body portion 10C is soldered on the board 2. In other words, the auxiliary portion 30C is separable from the body portion 10C at a boundary between the auxiliary portion 30C and the body portion 10C. More specifically, the coupling portion 34C is separable from the body portion 10C at the boundary between the coupling portion 34C and the body portion 10C. The separation portions 50C of the present embodiment are provided at two positions. As can be seen from FIG. 14, the two separation portions 50C are apart from each other in a width direction. In the present embodiment, the width direction is the Y-direction.

More specifically, the auxiliary portion 30C illustrated in FIG. 14 extends from the solderable portions 14C of the body portion 10C. Each of the separation portions 50C is provided on a boundary between the auxiliary portion 30C and the solderable portion 14C. In particular, each of the separation portions 50C of the present embodiment is provided on the boundary between the auxiliary portion 30C and the solderable portion 14C which is not the predetermined solderable portion 18C.

As shown in FIGS. 14 and 16, each of the separation portions 50C of the present embodiment is a notch or a V-groove. As can be seen from FIGS. 16 and 18, a board assembly 5C can be obtained as described below. First, the solderable portions 14C are soldered on the board 2. Then, the auxiliary portion 30C is turned about the separation portions 50C so that the solderable component 10 is divided at the separation portions 50C. As a result, the auxiliary portion 30C is separated from the body portion 10C, and thereby the board assembly 5C is formed.

When the auxiliary portion 30C and the body portion 10C are separated from each other by using the separation portions 50C of FIGS. 14 and 16, the soldered body portion 10C is formed with remaining portions 16C each having a broken-off trace as shown in FIG. 18. The thus-formed board assembly 5C of FIG. 18 comprises the board 2 and the body portion 10C. The body portion 10C has the main portion 12C, the at least two solderable portions 14C and the remaining portions 16C each having the broken-off trace. The at least two solderable portions 14C extend from the main portion 12C and are soldered on the board 2.

Referring to FIGS. 14 to 16, the coupling portion 34C of the present embodiment has two stand portions 36C, a horizontal portion 38C, a vertical portion 40C and a leg portion 42C. The stand portions 36C extend upward from the separation portions 50C in an upper-lower direction, respectively. In the present embodiment, the upper-lower direction is the Z-direction. The positive Z-direction is an upward direction. The negative Z-direction is a downward direction. The two stand portions 36C are apart from each other in the width direction and is located forward of the main portion 12C of the body portion 10C in a front-rear direction. In the present embodiment, the front-rear direction is the X-direction. The positive X-direction means forward. The negative X-direction means rearward. The upper-lower direction, the front-rear direction and the width direction described above are perpendicular to each other. The horizontal portion 38C couples the two stand portions 36C to each other in the width direction. The thus-formed horizontal portion 38C has a large size in the width direction. In the present embodiment, the large horizontal portion 38C also works as a flat-plate portion 60C which is used when the solderable component 1C is vacuum-sucked in a vacuum transfer device.

The horizontal portion 38C extends rearward in the front-rear direction over the body portion 10C. A front end of the horizontal portion 38C is located forward of the main portion 12C of the body portion 10C. A rear end of the horizontal portion 38C is located rearward of the main portion 12C.

The vertical portion 40C extends downward from the rear end of the horizontal portion 38C. The leg portion 42C extends downward from a part of the vertical portion 40C which is located at a lower end of the vertical portion 40C and is located at the middle of the vertical portion 40C in the width direction. The abutment portion 32C is provided at a lower end of the leg portion 42C. As can be seen from FIGS. 14 to 16, the abutment portion 32C is located between the two separation portions 50C in the width direction and is located at a position different from those of the separation portions 50C in the front-rear direction.

As can be seen from FIGS. 14 and 16, the abutment portion 32C and lower ends of the two predetermined solderable portions 18C define a board-attachment plane 70C which is an imaginary plane. The board-attachment plane 70C of the present embodiment is a plane in parallel to the XY-plane. Referring to FIGS. 16 and 18, the board-attachment plane 70C is flush with a surface of the board 2 when the solderable component 1C is mounted on the board 2.

When the solderable component 1C is mounted on the board 2, the abutment portion 32C is brought into contact with the board 2. In contrast, each of the solderable portions 14C which is not the predetermined solderable portion 18C is apart from the board-attachment plane 70C. In other words, at least a gap is formed between the board-attachment plane 70C and each of the solderable portions 14C which is not the predetermined solderable portion 18C. Thus, when the solderable component 1C is mounted on the board 2, the solderable component 10 is in contact with the board 2 at only three points consisting of the lower ends of the two predetermined solderable portions 18C and the abutment portion 32C. The thus-arranged solderable component 1C can stand by itself on the board 2 without wobbling.

Referring to FIGS. 14 to 16, the separation portions 50C are apart from the abutment portion 32C in the XY-plane. In other words, the boundary between the coupling portion 34C and the body portion 10C is apart from the abutment portion 32C in a plane in parallel to the board-attachment plane 70C. The thus-arranged auxiliary portion 30C is not brought into abutment with the board 2 when the auxiliary portion 30C is turned to be separated from the body portion 10C at the separation portions 50C.

As described above, each of the separation portions 50C of the present embodiment, i.e. the boundary between the coupling portion 34C and the body portion 100, is apart from the abutment portion 32C in a plane in parallel to the board-attachment plane 70C. According to this arrangement, the solderable component 1C of the present embodiment is hard to fall down and is easy to stably stand by itself on the board 2 upon soldering even when the body portion 10C has a tall structure.

Figure 17:
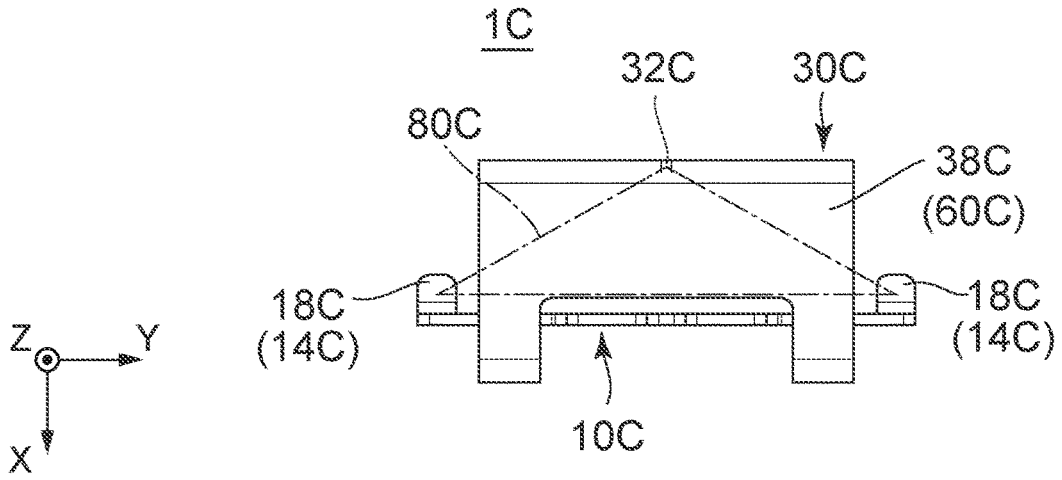
FIG. 17 is a top view showing the solderable component of FIG. 14.
Figure 18:
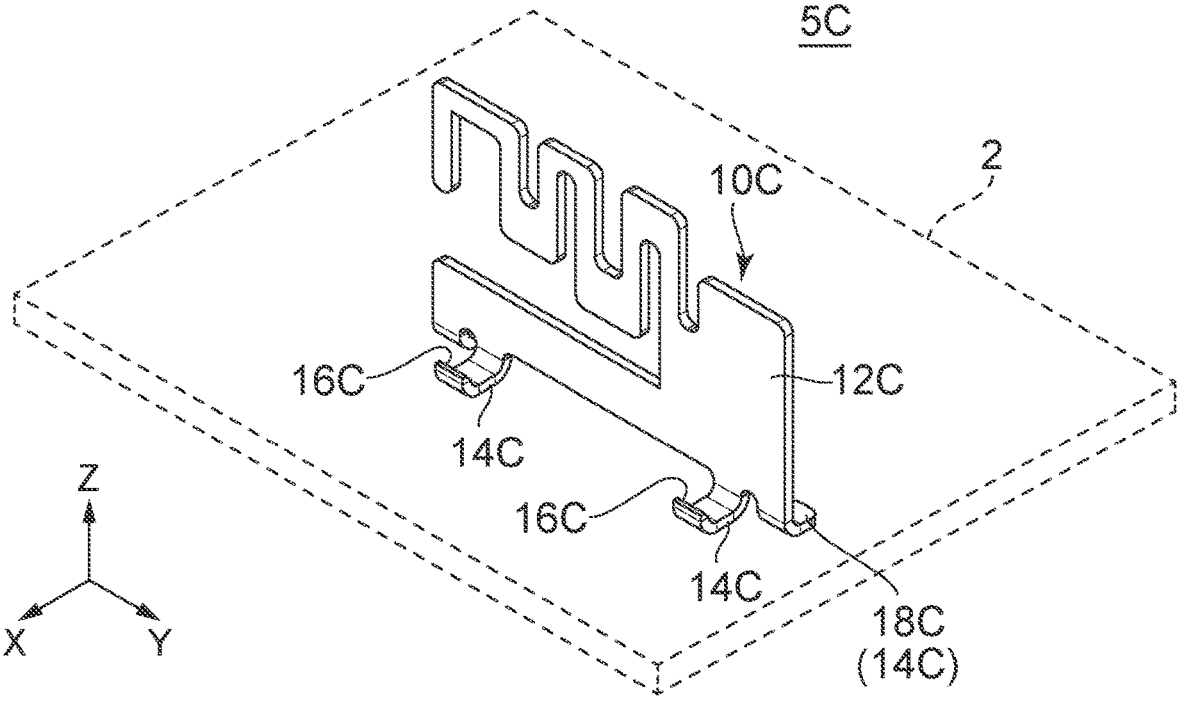
FIG. 18 is a perspective view showing a board assembly according to the fourth embodiment of the present invention.

As can be seen from FIGS. 16 and 17, the lower ends of the two predetermined solderable portions 18C and the abutment portion 32C are located at vertexes of a predetermined triangle region 80C in the board-attachment plane 70C, respectively. Meanwhile, the center of gravity of the solderable component 1C is located in the predetermined triangle region 80C when projected onto the board-attachment plane 70C. According to this arrangement, the solderable component 1C can more stably stand by itself on the board 2.

The flat-plate portion 60C is, at least in part, located in the predetermined triangle region 80C when seen along the upper-lower direction. Thus, the center of gravity of the solderable component 1C and the flat-plate portion 60C are located close to each other when seen along the upper-lower direction. According to this arrangement, when the flat-plate portion 60C is vacuum-sucked, the solderable component 1C can be held properly.

As can be seen from FIGS. 16 and 17, the auxiliary portion 30C is, at least in part, located outside the body portion 10C in a plane in parallel to the board-attachment plane 70C. In detail, when the body portion 10C is projected onto a region of the board-attachment plane 70C, a part of the auxiliary portion 30C which includes the abutment portion 32C is located out of a region which the body portion 10C occupies. As can be seen from FIGS. 14 and 18, by removing the auxiliary portion 30C after soldering, only the body portion 10C having a small mounting area is left on the board 2.

As can be seen from FIGS. 14, 16 and 18, since the coupling portion 34C has the stand portions 36C, some parts such as the horizontal portion 38C of the coupling portion 34C are apart from the board 2 under a state where the solderable component 1C is mounted on the board 2. Therefore, a region on the board 2 which is located under the coupling portion 34C can be used for some purpose.

Fifth Embodiment

Summarizing with reference to FIGS. 1 to 3 and FIGS. 19 to 22, a solderable component 1D according to a fifth embodiment of the present invention is different from the solderable component 1 of the first embodiment in the positional relation between the body portion 10 and the auxiliary portion 30 and the positional relation between a body portion 10D and an auxiliary portion 30D. Specifically, the body portion 10 of the solderable component 1 of the first embodiment is substantially located outside the auxiliary portion 30. In contrast, the body portion 10D of the solderable component 1D of the present embodiment is partially located inside the auxiliary portion 30D. Hereafter, specific explanation will be made about the solderable component 1D of the present embodiment. However, explanation will not be made about configurations similar to those of the solderable component 1 of the first embodiment.

Figure 19:
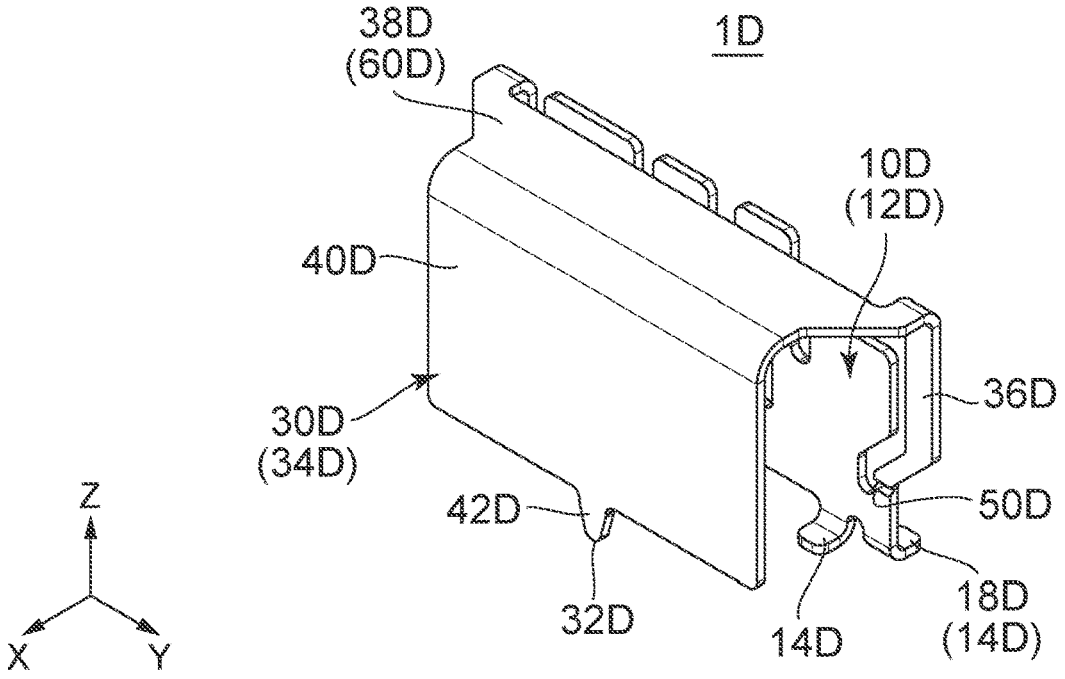
FIG. 19 is a perspective view showing a solderable component according to a fifth embodiment of the present invention.
Figure 20:
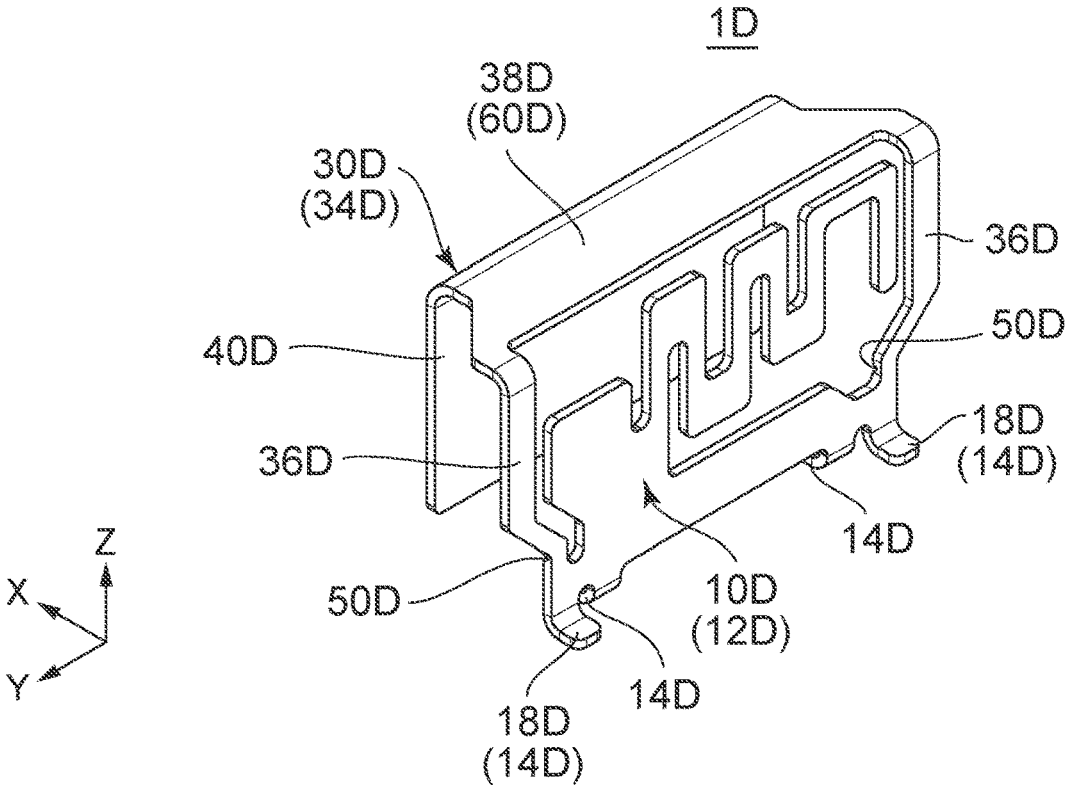
FIG. 20 is another perspective view showing the solderable component of FIG. 19.

Referring to FIGS. 19 to 22, the solderable component 1D of the fifth embodiment of the present invention is formed of a single metal plate. Referring to FIGS. 19, 20 and 23, the solderable component 1D of the present embodiment comprises the body portion 10D configured to be mounted on the board 2 and the auxiliary portion 30D extending from the body portion 10D.

Referring to FIGS. 19 to 23, the body portion 10D has a main portion 12D and at least two solderable portions 14D. The solderable portions 14D extend from the main portion 12D. The body portion 10D of the present embodiment has a total of four of the solderable portions 14D including two predetermined solderable portions 18D. Thus, in the present embodiment, the number of the solderable portions 14D excluding the predetermined solderable portions 18D is two.

As shown in FIG. 20, the body portion 10D is an electrical component. More specifically, the body portion 10D of the present embodiment is an antenna.

As shown in FIG. 19, the auxiliary portion 30D of the present embodiment has one abutment portion 32D and a coupling portion 34D. The coupling portion 34D couples the abutment portion 32D and the body portion 10D to each other.

Figure 21:
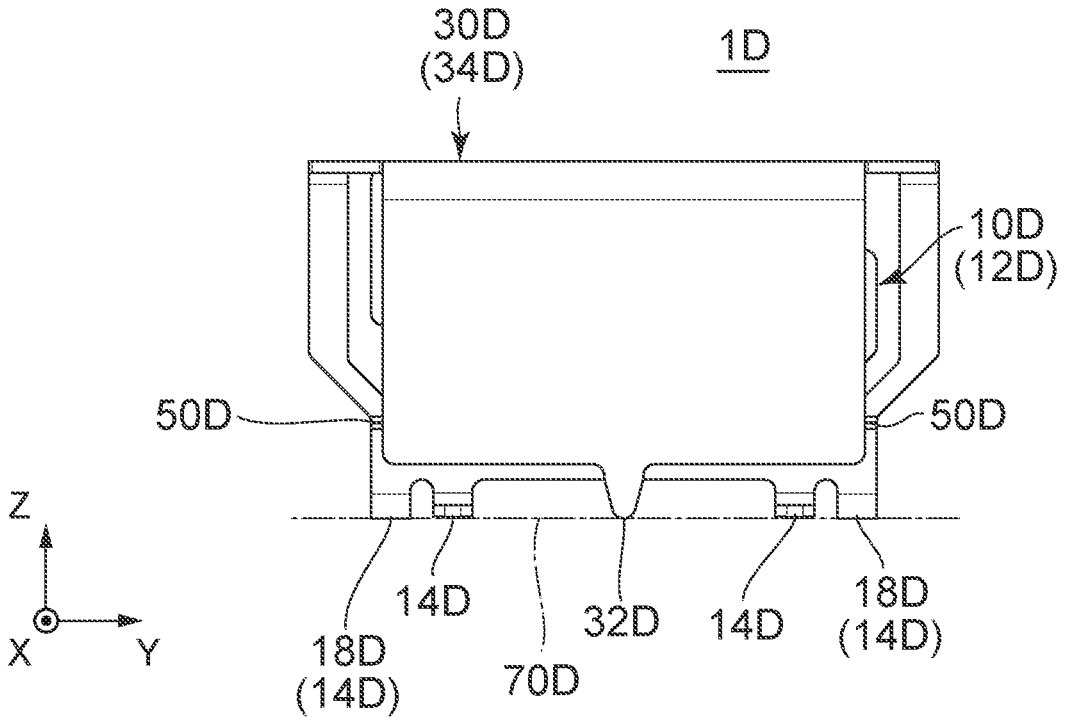
FIG. 21 is a front view showing the solderable component of FIG. 19.

As shown in FIGS. 19 to 21, in the present embodiment, a boundary between the coupling portion 34D and the body portion 10D is provided with separation portions 50D. As can be seen from FIGS. 19 and 23, the separation portions 50D are used for cutting out the auxiliary portion 30D from the body portion 10D after the body portion 10D is soldered on the board 2. In other words, the auxiliary portion 30D is separable from the body portion 10D at a boundary between the auxiliary portion 30D and the body portion 10D. More specifically, the coupling portion 34D is separable from the body portion 10D at the boundary between the coupling portion 34D and the body portion 10D. The separation portions 50D of the present embodiment are provided at two positions. As can be seen from FIGS. 20 and 21, the two separation portions 50D are apart from each other in a width direction. In the present embodiment, the width direction is the Y-direction.

More specifically, the auxiliary portion 30D illustrated in FIG. 20 extends from positions which are located at opposite ends of the body portion 10D in the width direction and are located above the predetermined solderable portions 18D. Each of the separation portions 50D is provided on a boundary between the auxiliary portion 30D and the main portion 12D. Moreover, each of the separation portions 50D is provided on a boundary between the auxiliary portion 30D and the solderable portion 14D. In the present embodiment, an upper-lower direction is the Z-direction. The positive Z-direction is an upward direction. The negative Z-direction is a downward direction.

As shown in FIGS. 19 and 20, each of the separation portions 50D of the present embodiment is a notch or a V-groove. As can be seen from FIGS. 20 and 23, a board assembly 5D can be obtained as described below. First, the solderable portions 14D are soldered on the board 2. Then, the auxiliary portion 30D is turned about the separation portions 50D so that the solderable component 1D is divided at the separation portions 50D. As a result, the auxiliary portion 30D is separated from the body portion 10D, and thereby the board assembly 5D is formed.

When the auxiliary portion 30D and the body portion 10D are separated from each other by using the separation portions 50D of FIGS. 19 and 20, the soldered body portion 10D is formed with remaining portions 16D each having a broken-off trace as shown in FIG. 23. The thus-formed board assembly 5D of FIG. 23 comprises the board 2 and the body portion 10D. The body portion 10D has the main portion 12D, the at least two solderable portions 14D and the remaining portions 16D each having the broken-off trace. The at least two solderable portions 14D extend from the main portion 12D and are soldered on the board 2.

Referring to FIGS. 19 and 20, the coupling portion 34D of the present embodiment has two stand portions 36D, a horizontal portion 38D, a vertical portion 40D and a leg portion 42D. The stand portions 36D extend upward from the separation portions 50D in the upper-lower direction, respectively. The two stand portions 36D are apart from each other in the width direction. The horizontal portion 38D couples the two stand portions 36D to each other in the width direction. The thus-formed horizontal portion 38D has a large size in the width direction. In the present embodiment, the large horizontal portion 38D also works as a flat-plate portion 60D which is used when the solderable component 1D is vacuum-sucked in a vacuum transfer device.

The horizontal portion 38D extends forward in a front-rear direction over an upper end of the body portion 10D. In the present embodiment, the front-rear direction is the X-direction. The positive X-direction means forward. The negative X-direction means rearward. The upper-lower direction, the front-rear direction and the width direction described above are perpendicular to each other.

The vertical portion 40D extends downward from a front end of the horizontal portion 38D. The leg portion 42D extends downward from a part of the vertical portion 40D which is located at a lower end of the vertical portion 40D and is located at the middle of the vertical portion 40D in the width direction. The abutment portion 32D is provided at a lower end of the leg portion 42D. As can be seen from FIGS. 19 and 21, the abutment portion 32D is located between the two separation portions 50D in the width direction and is located at a position different from those of the separation portions 50D in the front-rear direction.

As can be seen from FIG. 21, the abutment portion 32D and lower ends of the two predetermined solderable portions 18D define a board-attachment plane 70D which is an imaginary plane. The board-attachment plane 70D of the present embodiment is a plane in parallel to the XY-plane. Referring to FIGS. 21 and 23, the board-attachment plane 70D is flush with a surface of the board 2 when the solderable component 1D is mounted on the board 2.

When the solderable component 1D is mounted on the board 2, the abutment portion 32D is brought into contact with the board 2. In contrast, each of the solderable portions 14D which is not the predetermined solderable portion 18D is apart from the board-attachment plane 70D. In other words, at least a gap is formed between the board-attachment plane 70D and each of the solderable portions 14D which is not the predetermined solderable portion 18D. Thus, when the solderable component 1D is mounted on the board 2, the solderable component 1D is in contact with the board 2 at only three points consisting of the lower ends of the two predetermined solderable portions 18D and the abutment portion 32D. The thus-arranged solderable component 1D can stand by itself on the board 2 without wobbling.

Figure 22:
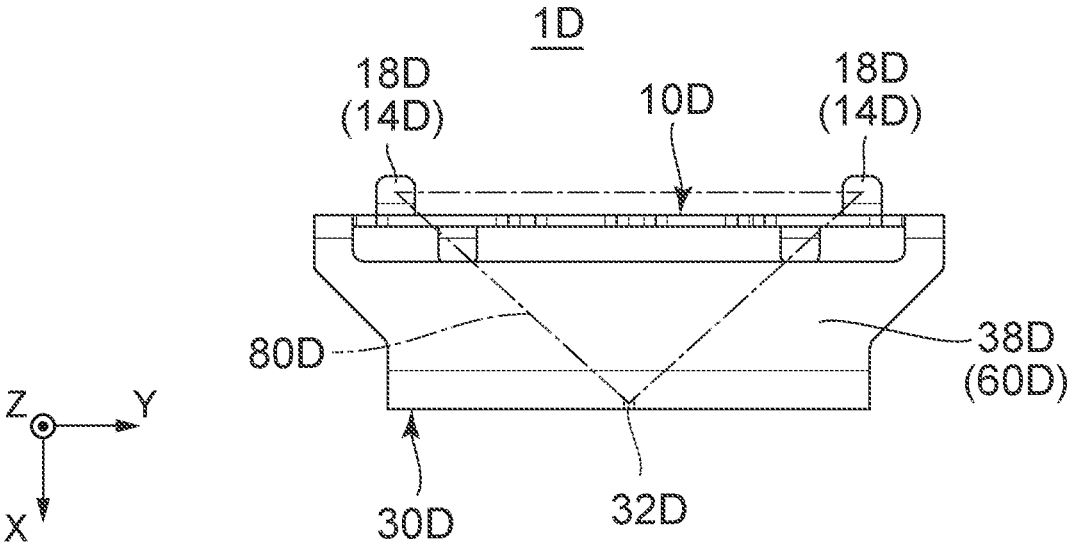
FIG. 22 is a top view showing the solderable component of FIG. 19.
Figure 23:
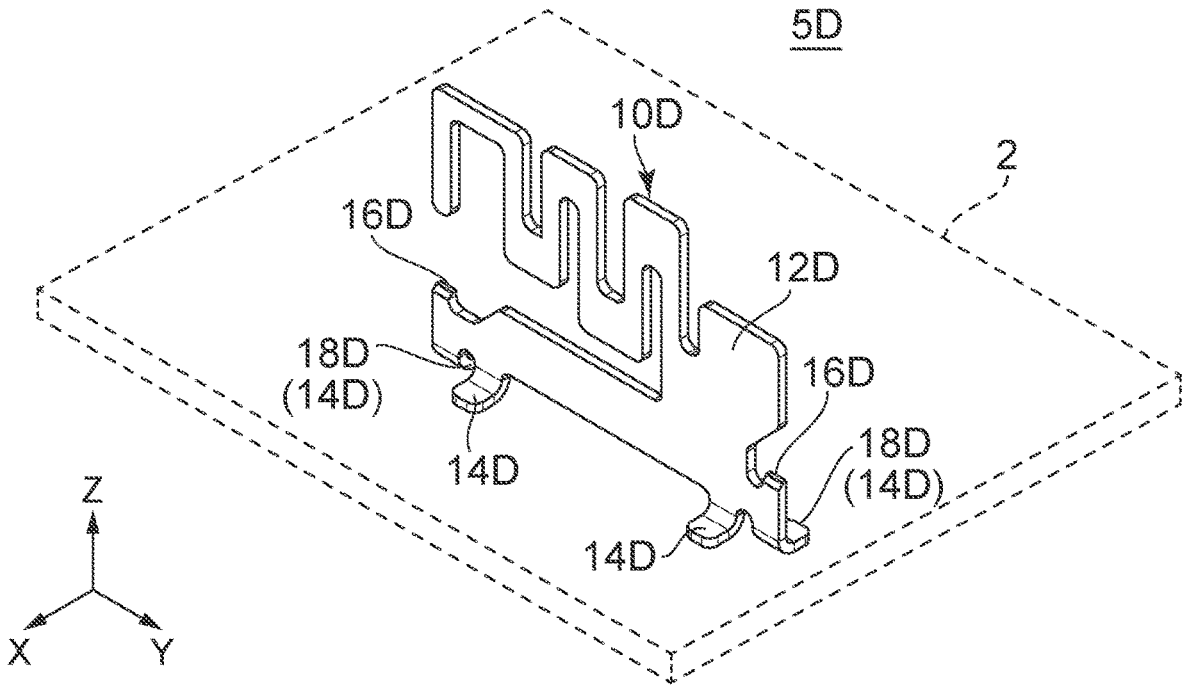
FIG. 23 is a perspective view showing a board assembly according to the fifth embodiment of the present invention.

Referring to FIGS. 19, 21 and 22, the separation portions 50D are apart from the abutment portion 32D in the XY-plane. In other words, the boundary between the coupling portion 34D and the body portion 10D is apart from the abutment portion 32D in a plane in parallel to the board-attachment plane 70D. The thus-arranged auxiliary portion 30D is not brought into abutment with the board 2 when the auxiliary portion 30D is turned to be separated from the body portion 10D at the separation portions 50D.

As described above, each of the separation portions 50D of the present embodiment, i.e. the boundary between the coupling portion 34D and the body portion 10D, is apart from the abutment portion 32D in a plane in parallel to the board-attachment plane 70D. According to this arrangement, the solderable component 1D of the present embodiment is hard to fall down and is easy to stably stand by itself on the board 2 upon soldering even when the body portion 10D has a tall structure.

As scan be seen from FIGS. 21 and 22, the lower ends of the two predetermined solderable portions 18D and the abutment portion 32D are located at vertexes of a predetermined triangle region 80D in the board-attachment plane 70D, respectively. Meanwhile, the center of gravity of the solderable component 1D is located in the predetermined triangle region 80D when projected onto the board-attachment plane 70D. According to this arrangement, the solderable component 1D can more stably stand by itself on the board 2.

The flat-plate portion 60D is, at least in part, located in the predetermined triangle region 80D when seen along the upper-lower direction. Thus, the center of gravity of the solderable component 1D and the flat-plate portion 60D are located close to each other when seen along the upper-lower direction. According to this arrangement, when the flat-plate portion 60D is vacuum-sucked, the solderable component 1D can be held properly.

As can be seen from FIGS. 20 and 22, the auxiliary portion 30D is, at least in part, located outside the body portion 10D in a plane in parallel to the board-attachment plane 70D. In detail, when the body portion 10D is projected onto a region of the board-attachment plane 70D, a part of the auxiliary portion 30D which includes the abutment portion 32D is located out of a region which the body portion 10D occupies. As can be seen from FIGS. 19 and 23, by removing the auxiliary portion 30D after soldering, only the body portion 10D having a small mounting area is left on the board 2.

As can be seen from FIGS. 19, 20 and 23, since the coupling portion 34D has the stand portions 36D, some parts such as the horizontal portion 38D of the coupling portion 34D are apart from the board 2 under a state where the solderable component 1D is mounted on the board 2. Therefore, a region on the board 2 which is located under the coupling portion 34D can be used for some purpose.

Sixth Embodiment

Summarizing with reference to FIGS. 1 to 3 and FIGS. 24 to 28, a solderable component 1E according to a sixth embodiment of the present invention is different from the solderable component 1 of the first embodiment in the features that the auxiliary portion 30 and the body portion 10 are a unitary member while an auxiliary portion 30E and a body portion 10E are binary members. Specifically, the solderable component 1 of the first embodiment is formed of a single metal plate. In contrast, the auxiliary portion 30E of the solderable component 1E of the present embodiment is a component which is formed separately from a body portion 10E. Hereafter, specific explanation will be made about the solderable component 1E of the present embodiment. However, explanation will not be made about configurations similar to those of the solderable component 1 of the first embodiment.

Figure 24:
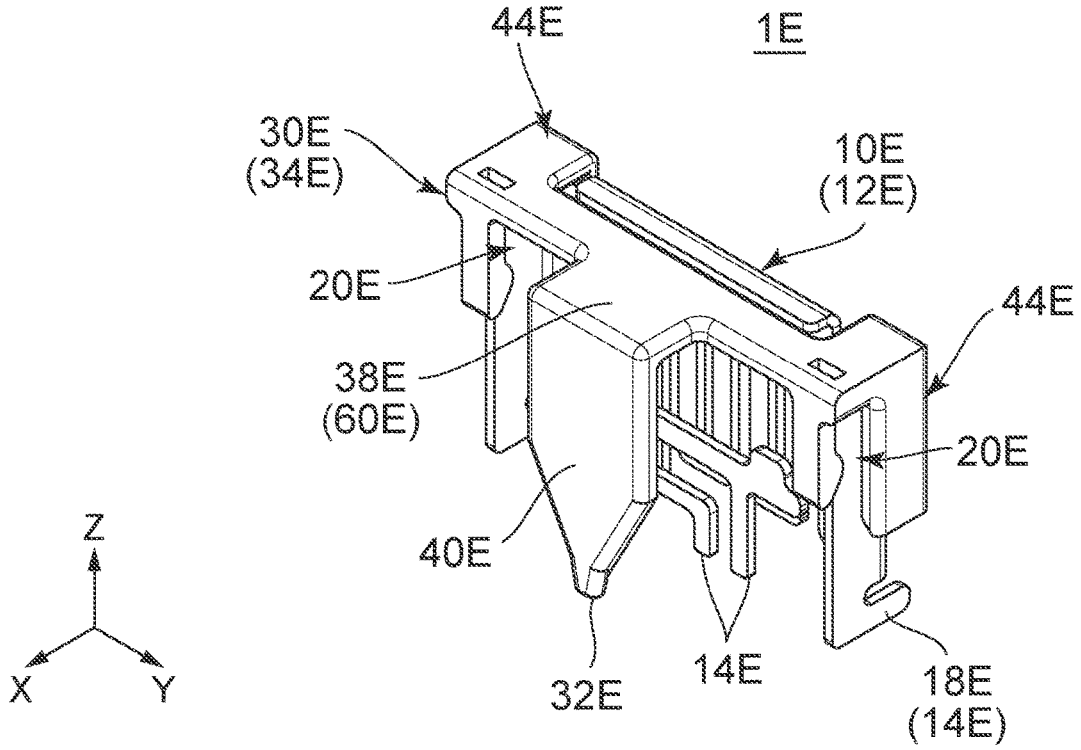
FIG. 24 is a perspective view showing a solderable component according to a sixth embodiment of the present invention.
Figure 25:
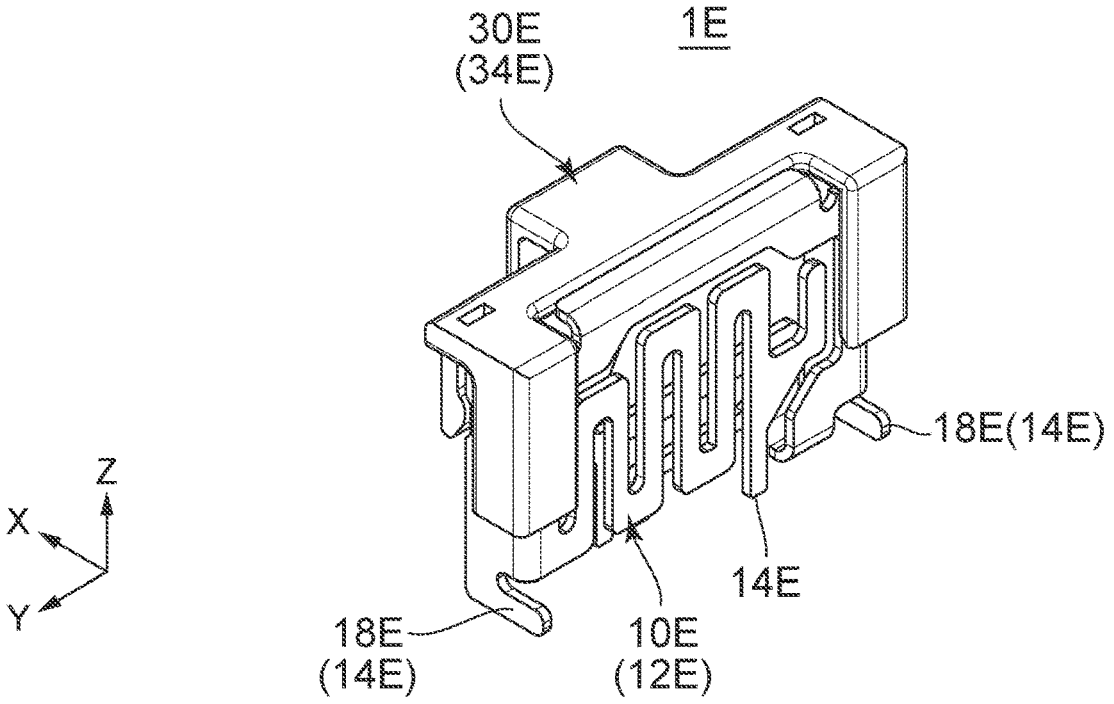
FIG. 25 is another perspective view showing the solderable component of FIG. 24.
Figure 29:
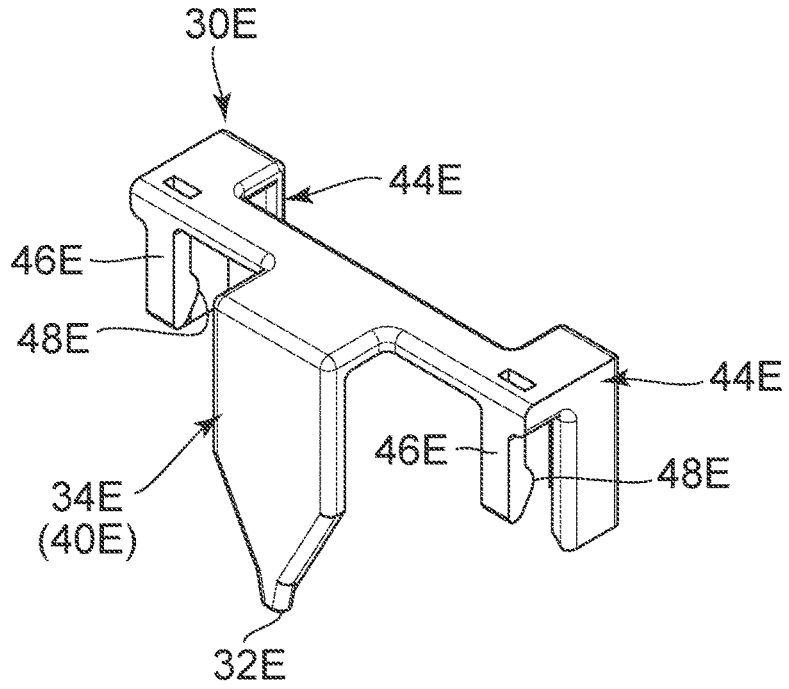
FIG. 29 is a perspective view showing a board assembly and an auxiliary portion according to the sixth embodiment of the present invention.
Figure 29:
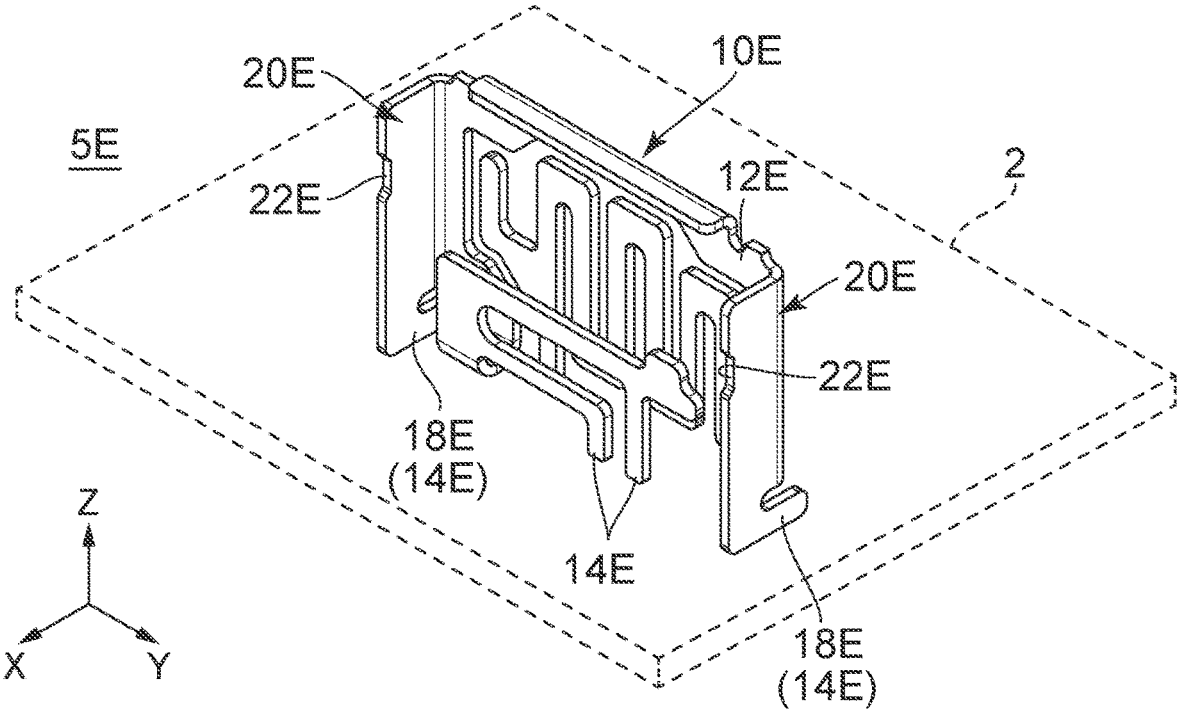

Referring to FIGS. 24 and 29, the solderable component 1E of the sixth embodiment of the present invention comprises the body portion 10E and the auxiliary portion 30E. The body portion 10E is made of a metal plate and is configured to be mounted on the board 2. The auxiliary portion 30E is made of resin and is attached to the body portion 10E. The materials of the body portion 10E and the auxiliary portion 30E are not limited thereto, but the body portion 10E and the auxiliary portion 30E may be formed of the other materials, respectively.

Referring to FIGS. 24 to 27, the body portion 10E has a main portion 12E, at least two solderable portions 14E and two held portions 20E. The solderable portions 14E extend from the main portion 12E. The body portion 10E of the present embodiment has a total of five of the solderable portions 14E including two predetermined solderable portions 18E. Thus, in the present embodiment, the number of the solderable portions 14E excluding the predetermined solderable portions 18E is three. The predetermined solderable portions 18E of the present embodiment are two of the solderable portions 14E each of which is located at an outermost position in a width direction. In the present embodiment, the width direction is the Y-direction. The two held portions 20E are located above the predetermined solderable portions 18E, respectively. In the present embodiment, an upper-lower direction is the Z-direction. The positive Z-direction is an upward direction. The negative Z-direction is a downward direction. The held portions 20E are provided with recessed portions 22E, respectively. Each of the recessed portion 22E is formed on a front edge of the held portion 20E and is recessed rearward. In the present embodiment, a front-rear direction is the X-direction. The positive X-direction means forward. The negative X-direction means rearward. The upper-lower direction, the front-rear direction and the width direction described above are perpendicular to each other.

As shown in FIG. 29, the body portion 10E is an electrical component. More specifically, the body portion 10E of the present embodiment is an antenna.

As shown in FIGS. 24 and 29, the auxiliary portion 30E of the present embodiment has one abutment portion 32E and a coupling portion 34E. The coupling portion 34E couples the abutment portion 32E and the body portion 10E to each other.

Figure 26:
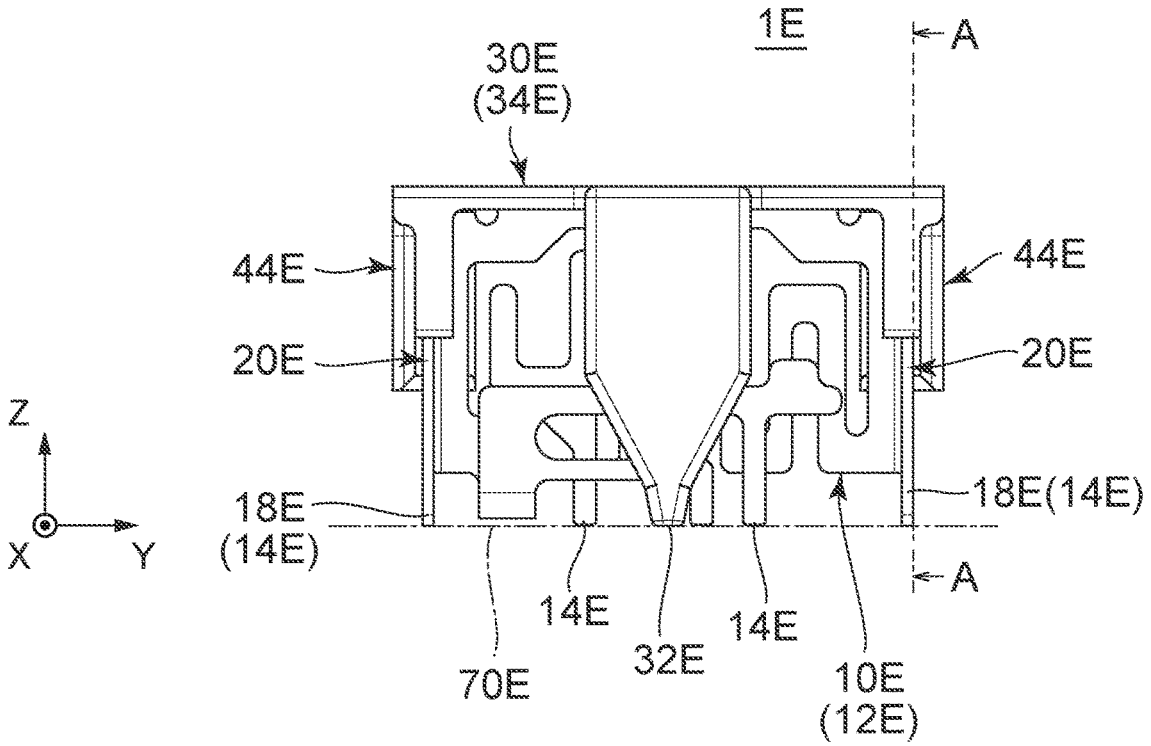
FIG. 26 is a front view showing the solderable component of FIG. 24.

As shown in FIGS. 24 and 29, the coupling portion 34E of the present embodiment has two holding portions 44E, a horizontal portion 38E and a vertical portion 40E. The holding portions 44E are apart from each other in the width direction. As shown in FIGS. 26 and 29, each of the holding portions 44E has a resiliently deformable support portion 46E and a projecting portion 48E supported by the support portion 46E. The projecting portion 48E bulges rearward. As can be seen from FIGS. 24, 26 and 29, the held portions 20E are covered by the holding portions 44E from above, respectively, and the projecting portions 48E are caught in the recessed portions 22E, respectively. The holding portions 44E hold the held portions 20E, respectively, as described above. In the present embodiment, contact regions between the recessed portions 22E and the projecting portions 48E define a boundary between the body portion 10E and the auxiliary portion 30E. The thus-arranged auxiliary portion 30E is separable from the body portion 10E at the boundary between the auxiliary portion 30E and the body portion 10E. More specifically, the coupling portion 34E is separable from the body portion 10E at a boundary between the coupling portion 34E and the body portion 10E.

As shown in FIG. 29, a board assembly 5E can be obtained as described below. First, the solderable portions 14E are soldered on the board 2. Then, the auxiliary portion 30E is pulled out upward. As a result, the auxiliary portion 30E is separated from the body portion 10E, and thereby the board assembly 5E is formed.

As shown in FIG. 24, the horizontal portion 38E couples the two holding portions 44E to each other in the width direction. The thus-formed horizontal portion 38E has a large size in the width direction. In the present embodiment, the large horizontal portion 38E also works as a flat-plate portion 60E which is used when the solderable component 1E is vacuum-sucked in a vacuum transfer device.

Figure 27:
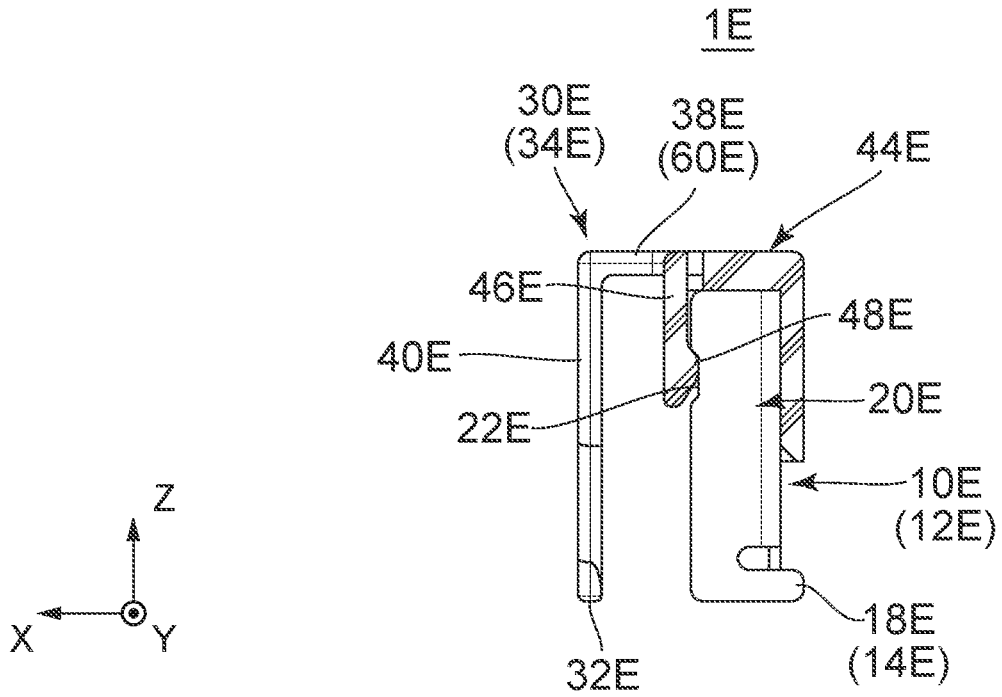
FIG. 27 is a cross-sectional view showing the solderable component of FIG. 26, taken along line A-A.

As shown in FIG. 27, the horizontal portion 38E extends forward in the front-rear direction over the body portion 10E. The vertical portion 40E extends downward from a front end of the horizontal portion 38E. The abutment portion 32E is provided at a part of the vertical portion 40E which is located at a lower end of the vertical portion 40E and is located at the middle of the vertical portion 40E in the width direction. As can be seen from FIGS. 26 and 27, the abutment portion 32E is located between the two holding portions 44E in the width direction and is located at a position different from those of the holding portions 44E in the front-rear direction.

Figure 28:
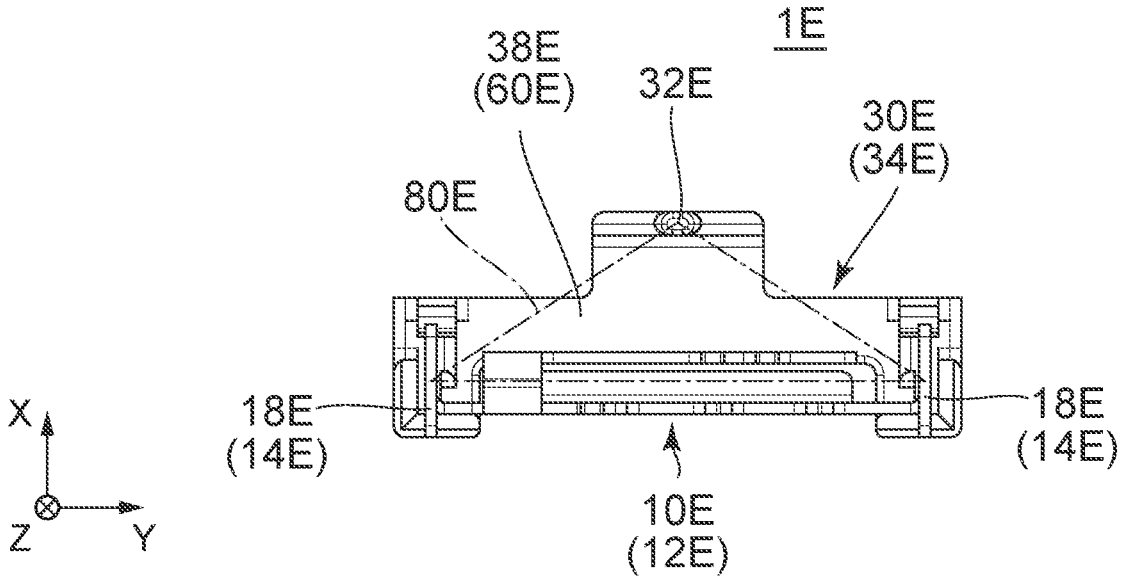
FIG. 28 is a bottom view showing the solderable component of FIG. 24.

As can be seen from FIGS. 26 and 28, the abutment portion 32E and lower ends of the two predetermined solderable portions 18E define a board-attachment plane 70E which is an imaginary plane. The board-attachment plane 70E of the present embodiment is a plane in parallel to the XY-plane. Referring to FIGS. 26 and 29, the board-attachment plane 70E is flush with a surface of the board 2 when the solderable component 1E is mounted on the board 2.

When the solderable component 1E is mounted on the board 2, the abutment portion 32E is brought into contact with the board 2. In contrast, each of the solderable portions 14E which is not the predetermined solderable portion 18E is apart from the board-attachment plane 70E. In other words, at least a gap is formed between the board-attachment plane 70E and each of the solderable portions 14E which is not the predetermined solderable portion 18E. Thus, when the solderable component 1E is mounted on the board 2, the solderable component 1E is in contact with the board 2 at only three points consisting of the lower ends of the two predetermined solderable portions 18E and the abutment portion 32E. The thus-arranged solderable component 1E can stand by itself on the board 2 without wobbling.

As described above, the boundary between the coupling portion 34E and the body portion 10E is formed of the contact regions each of which is located between the holding portion 44E and the held portion 20E. In detail, the boundary between the coupling portion 34E and the body portion 10E is formed of the contact regions each of which is located between the projecting portion 48E and the recessed portion 22E. This boundary between the coupling portion 34E and the body portion 10E is apart from the abutment portion 32E in a plane in parallel to the board-attachment plane 70E. According to this arrangement, the solderable component 1E of the present embodiment is hard to fall down and is easy to stably stand by itself on the board 2 upon soldering even when the body portion 10E has a tall structure.

As can be seen from FIGS. 27 and 28, the lower ends of the two predetermined solderable portions 18E and the abutment portion 32E are located at vertexes of a predetermined triangle region 80E in the board-attachment plane 70E, respectively. Meanwhile, the center of gravity of the solderable component 1E is located in the predetermined triangle region 80E when projected onto the board-attachment plane 70E. According to this arrangement, the solderable component 1E can more stably stand by itself on the board 2.

The flat-plate portion 60E is, at least in part, located in the predetermined triangle region 80E when seen along the upper-lower direction. Thus, the center of gravity of the solderable component 1E and the flat-plate portion 60E are located close to each other when seen along the upper-lower direction. According to this arrangement, when the flat-plate portion 60E is vacuum-sucked, the solderable component 1E can be held properly.

As can be seen from FIGS. 27 and 28, the auxiliary portion 30E is, at least in part, located outside the body portion 10E in a plane in parallel to the board-attachment plane 70E. In detail, when the body portion 10E is projected onto a region of the board-attachment plane 70E, a part of the auxiliary portion 30E which includes the abutment portion 32E is located out of a region which the body portion 10E occupies. As can be seen from FIGS. 24 and 29, by removing the auxiliary portion 30E after soldering, only the body portion 10E having a small mounting area is left on the board 2.

Although specific explanation has been made about the present invention with reference to embodiments, the present invention is not limited thereto but can be modified variously.

What is claimed is:

1. A solderable component comprising a body portion configured to be mounted on a board and an auxiliary portion extending from the body portion, wherein:

the body portion has at least two solderable portions;

the at least two solderable portions include two predetermined solderable portions;

the auxiliary portion has one abutment portion and a coupling portion;

the abutment portion and lower ends of the two predetermined solderable portions define a board-attachment plane;

the coupling portion couples the abutment portion and the body portion to each other;

a boundary between the coupling portion and the body portion is apart from the abutment portion in a plane in parallel to the board-attachment plane; and the coupling portion is separable from the body portion at the boundary between the coupling portion and the body portion.

2. The solderable component as recited in claim 1, wherein each of the at least two solderable portions which is not the predetermined solderable portion is apart from the board-attachment plane.

3. The solderable component as recited in claim 1, wherein:

the lower ends of the two predetermined solderable portions and the abutment portion are located at vertexes of a predetermined triangle region in the board-attachment plane, respectively; and the solderable component has its center of gravity which is located in the predetermined triangle region when projected onto the board-attachment plane.

4. The solderable component as recited in claim 1, wherein the solderable component is formed of a single metal plate.

5. The solderable component as recited in claim 1, wherein the body portion is an electrical component.

6. The solderable component as recited in claim 1, wherein the boundary between the coupling portion and the body portion is provided with a separation portion for cutting out the auxiliary portion from the body portion after the body portion is soldered on the board.

7. The solderable component as recited in claim 6, wherein:

the auxiliary portion extends from the at least two solderable portions; and the separation portion is provided on a boundary between the auxiliary portion and the at least two solderable portions.

8. The solderable component as recited in claim 6, wherein:

the body portion has a main portion;

the at least two solderable portions extend from the main portion; and the separation portion is provided on a boundary between the auxiliary portion and the main portion.

9. The solderable component as recited in claim 6, wherein the coupling portion has a stand portion which extends upward from the separation portion.

10. The solderable component as recited in claim 6, wherein the separation portion is a notch.

* * * * *